United States Patent [19]

Horne et al.

[11] Patent Number: 4,603,330

[45] Date of Patent: Jul. 29, 1986

[54] FONT DISPLAY AND TEXT EDITING SYSTEM WITH CHARACTER OVERLAY FEATURE

[75] Inventors: Gary D. Horne; Martin G. Gottschalk, both of Highland; Rainer A. Oehm, Wallkill, all of N.Y.

[73] Assignee: High Technology Solutions, Inc., Poughkeepsie, N.Y.

[21] Appl. No.: 432,319

[22] Filed: Oct. 1, 1982

[51] Int. Cl.[4] ..... G09G 1/16

[52] U.S. Cl. ..... 340/735; 340/745

[58] Field of Search ..... 340/735, 724, 745, 751

[56] References Cited

U.S. PATENT DOCUMENTS

| | | | |
|---|---|---|---|
| 3,735,383 | 5/1973 | Naka | 340/745 |
| 4,163,229 | 7/1979 | Bodin et al. | 340/735 |
| 4,195,338 | 3/1980 | Freeman | 340/724 |
| 4,429,306 | 1/1984 | Macauley et al. | 340/745 |
| 4,490,789 | 12/1984 | Leban et al. | 340/751 |

*Primary Examiner*—Marshall M. Curtis

*Attorney, Agent, or Firm*—Ostrolenk, Faber, Gerb & Soffen

[57] ABSTRACT

A font display and text editing system is disclosed. The system includes a display medium for displaying text characters. A memory stores digital information describing the shape of each alphabetical character of a plurality of sets of alphabetical characters, each of the sets of alphabetial characters defining a respective font. An input device sequentially generates a first signal identifying one of the alphabetical characters as a base character and a second signal identifying a different one of the alphabetic characters as an overlay character. A circuit responsive to the signals displays the base and overlay characters as a single complex character on the display medium.

28 Claims, 21 Drawing Figures

10
FONT ROM
PROGRAM ROM
TEXT BUFFER AND SCRATCH PAD RAM
DECODER
ADDRESS BUS
DATA BUS
ADDRESS LATCH
X-CVR
LATCH
LATCH
DISPLAY RAM
CRT
KEYBOARD
MICRO-PROCESSOR
CLOCK
A1-16
D0-15
D0-19
A0-19
D0-12
D0-11
D0-A15
A1-A16
A17
A18
A19
ALE
DEN
DT/R
RD
WR
CE
OE
WE
STB
TRANS
DATA
ADD
E1
E2
E3
E4
E5
E6
12
14
16
18
20
22
24
26
28
30
31
32
34
35
36
38
40

| | | | | | | | | | | | | | | | |
|---|---|---|---|---|---|---|---|---|---|---|---|---|---|---|---|
| WORD 1: | O | O | O | O | O | O | O | O | O | O | O | O | O | O | O |
| 2: | O | O | O | O | O | O | O | O | O | O | O | O | O | O | O |
| 3: | O | O | O | O | O | O | O | O | O | O | O | O | O | O | O |
| 4: | O | O | O | O | O | O | O | O | O | O | O | O | O | O | O |
| 5: | O | O | O | O | O | O | O | O | O | O | O | O | O | O | O |
| 6: | O | O | O | O | O | O | O | O | O | O | O | O | O | O | O |
| 7: | O | O | O | O | O | O | O | O | O | O | O | O | O | O | O |
| 8: | O | O | O | O | O | O | O | O | O | O | O | O | O | O | O |
| 9: | O | O | O | O | O | O | O | O | O | O | O | O | O | O | O |
| 10: | O | O | O | O | O | O | O | O | O | O | O | O | O | O | O |
| 11: | O | O | O | O | O | O | O | O | O | O | O | O | O | O | O |
| 12: | O | O | O | O | O | O | O | O | O | O | O | O | O | O | O |
| 13: | O | O | O | O | O | O | O | O | O | O | O | O | O | O | O |
| 14: | O | O | O | O | O | O | O | O | O | O | O | O | O | O | O |
| 15: | O | O | O | O | O | O | O | O | O | O | O | O | O | O | O |
| 16: | O | O | O | O | O | O | O | O | O | O | O | O | O | O | O |

SUBROUTINE-300

SUBROUTINE-400

SUBROUTINE 600

SUBROUTINE-700

FONT DISPLAY AND TEXT EDITING SYSTEM WITH CHARACTER OVERLAY FEATURE

BACKGROUND OF THE INVENTION

The present invention is directed towards an electronic text display system such as are commonly used for word processing, text composing, and the like. The present invention is particularly useful in connection with electronic text composing systems wherein text information including character information defining the text to be presented, font information defining the style of font in which selected portions of the text are to be presented, and composition information such as column spacing, and the like, are all entered into the system and displayed on a display device such as a CRT. The text information is ultimately transferred to an electronic photocomposer which forms photographic negatives which can be used to make printing plates in what is known as the cold-type process. The photographic negatives contain the characters defining the text to be presented in the desired font style and with the desired composition in accordance with the text information which had been entered into the electronic text composing system.

In prior art text composing systems, such as the Printext composing system sold by IBM, the set of characters or symbols which can be represented on the display medium is limited to one font style. This is a highly limiting feature since the user cannot obtain an accurate representation of the actual font style which will be ultimately produced on the printed page. While special symbols may be displayed on the display medium to indicate the fact that associated characters will ultimately be presented in a specific font style, the actual characters dislayed on the display medium will be formed in a single font style. This requires that the user of the system use his imagination to determine what the final printed page will actually look like. Often a certain composition scheme which appears to be aesthetically pleasing in the single style font displayed on the display medium turns out to be quite unsatisfactory when transferred to the printed page with the actual font style.

In an effort to overcome this drawback, at least one composing system manufactured by Compugraphics utilizes a preview screen to provide a detailed an accurate image of different font styles and weights as they will ultimately appear on the printed page. In this system, however, text data is initially, edited and composed on a standard CRT display capable of illustrating only a single font style. Once the user has completed his editing and composition of the page of text, he can display an accurate image of the composed data on a separate preview screen for review before electronic phototypesetting takes place. The information displayed on the preview screen cannot, however, be edited or recomposed on the preview screen. Accordingly, if the user does not like the composition of the page he must return to the standard CRT display and must recompose the page of data using the single character set. Accordingly, he cannot be sure that the final composition will be satisfactory until he completes his editing and again transfers the information to the preview screen.

BRIEF DESCRIPTION OF THE PRESENT INVENTION

The present invention overcomes the foregoing deficiencies of the prior art by providing a display screen which provides a detailed and accurate image of different fonts and weights and which permits the user of the system to interactively edit and compose the information displayed on the screen. This result is achieved by storing characters for a plurality of font styles in digital form with the shape of each character being described by a unique character set of digital words. The system may be provided with as many text editing and/or composing capabilities as is desired.

In the preferred embodiment, the display medium forms the desired character from a plurality of dots or pixels which are arranged at predetermined locations in a character cell which may be of constant or variable size. The character cell defines a space on the display medium in which the character may be presented. The character cell is preferably divided into a grid of pixel locations, each of which may contain a single pixel. By placing pixels in only selected pixel locations of the grid, the display medium can produce a character having substantially any form desired.

In the preferred embodiment, the shape of each character is defined by a unique character set comprising a plurality of data words. These data words contain information regarding the locations of the pixels within a character cell which are required to produce the desired character shape. Since the number of characters and font styles which may be reproduced in this manner is limited only by the size and number of pixel elements in a character cell and the size of the font memory holding the data words, presentation of the characters in this pixel matrix form provides for great flexibility in the system.

The text editing and composing capability of the system are made possible primarily through the use of a bit mapped RAM which contains storage locations which correspond on a one-to-one basis to the pixel locations on the display medium. In the preferred embodiment, the system is run by a microprocessor which constantly monitors keyboard instructions generated by a user controlled keyboard. These instructions provide information regarding the particular character and font style which the user wishes to display on the display medium. The keyboard also provides the microprocessor with information which enables the microprocessor to determine the location on the display medium where the character identified by the character code is to be placed. Whenever a new keyboard instruction is generated by the keyboard, the microprocessor removes the character set associated with the character and font identified by the character code from the font memory and stores the data words of that character set in memory locations of the bit mapped RAM which correspond to the location on the display medium where the character is to be displayed. Since the display medium reproduces the pixel information stored in the bit mapped RAM on its own screen, the user can place desired characters from any selected font at any location on the display medium by causing the microprocessor to place the appropriate character sets in the appropriate storage locations of the bit mapped RAM in response to appropriate entries into the keyboard.

By defining the character shape in the form of a unique character set which identifies the pixel location within a character cell required to reproduce that character shape and by placing that information in any desired location of the bit mapped RAM, the present invention makes it possible to incorporate substantially any text editing and composing capability which is used on standard text editing and electronic composing systems. Since these text editing and composition capabilities are per se known and do not themselves define the inventive features of the present invention, the following detailed description of the invention is directed primarily to the font display features of the system. Relatively few text editing features have been described. It should be understood, however, that any presently known or future developed text editing and/or composing capabilities can be incorporated into the system without departing from the spirit or scope of the present invention.

A major feature of the present invention is the ability to create complex characters by first entering a base character and displaying it on the CRT display and then entering an overlay character (such as a diacritic) and placing that onto the display over the base character. For example, the user of the system can depress a key corresponding to the base character "a" which will be placed in a given cell location on the CRT display. The user can then depress a key corresponding to the overlay character " ·· " with the result that the overlay character will be placed on top of the base character in the character cell. In this manner, the user has created the complex character "ä".

The text editing system places base and overlay characters on the screen in response to base and overlay character keyboard instructions generated by an appropriate input device, such as a programmable keyboard. If desired, the keyboard can be programmed to generate a string of characters in response to the depression of a single key. In such a case, the depression of a single key can cause the keyboard to sequentially generate a base character keyboard instruction corresponding to the base character of the complex character and then can generate one or more overlay character keyboard instructions corresponding to the one or more overlay characters to be added to the base character. In the example noted above, the depression of the single key would cause the keyboard to first generate the base character keyboard instruction corresponding to the character "a" and then generate the overlay character keyboard instruction corresponding to the diacritic " ·· ". These two keyboard instructions are generated at electronic speeds so that the complex character "ä" seems to be generated in a single step on the CRT display.

As noted above, the invention preferably employs a bit mapped RAM which is functionally divided into character cells corresponding to the character cells on the CRT display. In order to building the complex character in a given cell location, the system microprocessor first places the base character in the character cell in the bit mapped RAM corresponding to the character cell in the CRT display where the complex character is to be located in response to the base character keyboard instruction. When the system microprocessor receives the overlay character keyboard instruction from the keyboard, it adds the pixel locations corresponding to the overlay character to the base character stored in the character cell.

BRIEF DESCRIPTION OF THE DRAWINGS

For the purpose of illustrating the invention, there is shown in the drawings an embodiment which is presently preferred, it being understood, however, that the invention is not limited to the precise arrangements and instrumentalities shown.

DETAILED DESCRIPTION OF THE INVENTION

Figure 1:
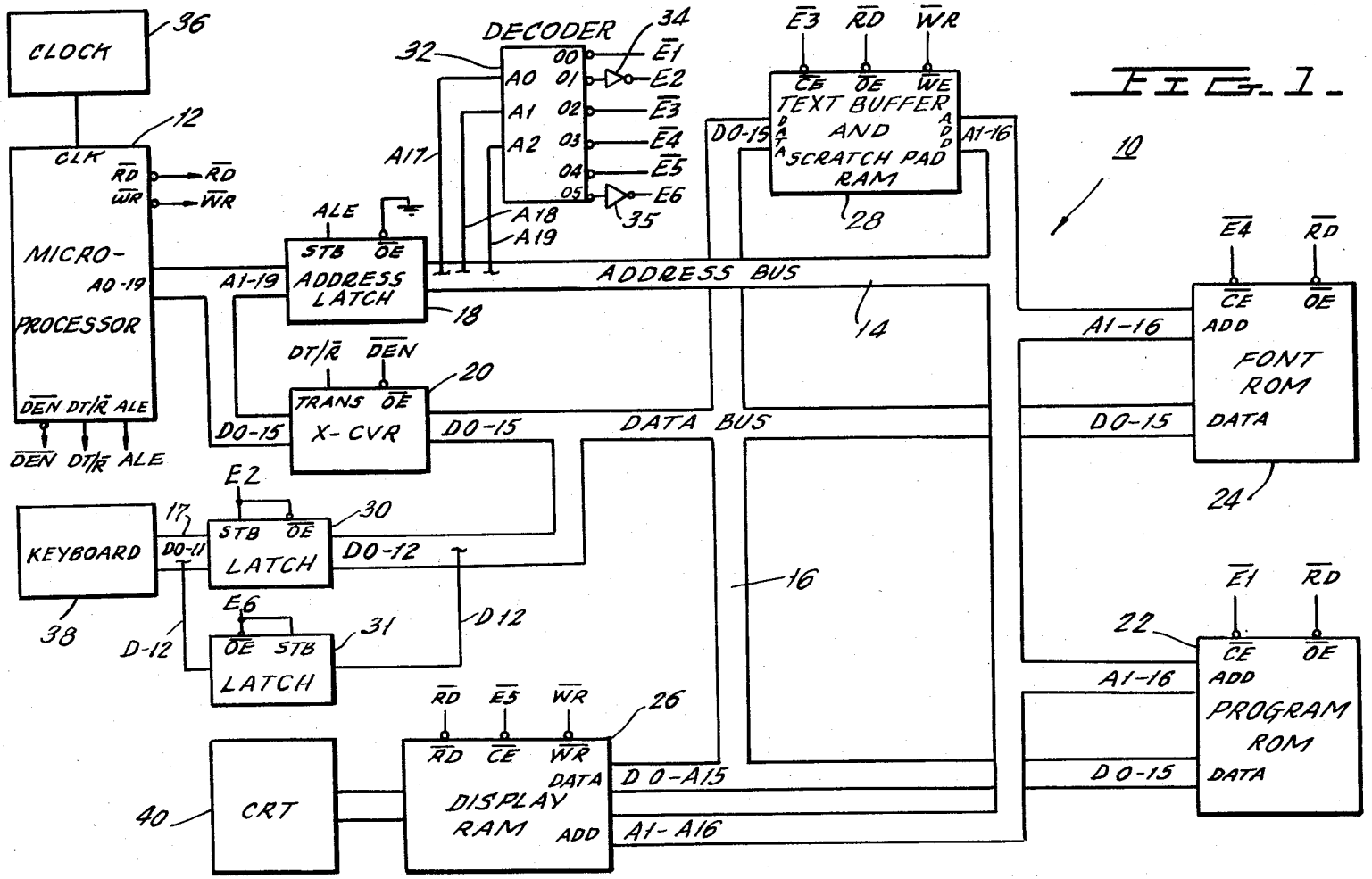
FIG. 1 is a schematic diagram of the hardware of the font display and text editing system of the present invention.

Referring now to the drawings wherein like numerals indicate like elements, there is shown in FIG. 1 a font display and text editing system constructed in accordance with the principles of the present invention and designated generally as 10.

MAIN SYSTEM

The heart of font display and text editing system 10 is a microprocessor 24 which may be an 8086 microprocessor manufactured by Intel Corporation. A complete description of the structure and operation of this microprocessor, as well as various applications thereof, is described in Intel's "iPX 86, 88 User's Manual" dated Aug. 21, 1981. The disclosure of this manual is incorporated herein by reference.

Throughout the following description, reference will be made to signals which are either active low or active high. An active low signal will be indicated by the presence of a line over the signal (e.g., $\overline{DEN}$). An active low signal will be referred to as being set or generated when it is at the binary "0" level and reset when it is at the binary "1" level. An active high signal will be referred to as being set or generated when it is at the binary "1" level and being reset when it is at the binary "0" level.

In addition to active low and active high signals, various elements of system 10 have active high and active low inputs and outputs. An active low input or output will be indicated by the presence of a small circle at the input or output of the element. For example, each of the outputs of the 3 to 8 decoder 44 ar active low outputs. An active low input will be activated by the presence of a binary "0" on its input. An active low output will place a binary "0" on its output when it is activated. Any input or output which is not indicated to be active low is active high.

Microprocessor 12 communicates with the remaining elements of system 10 by writing address information onto address bus 14 and by both writing information onto and reading information off of data bus 16. Microprocessor 12 has a common set of input/output ports A0–A19 which are connected to both address bus 14 and data bus 16 through address latch 18 and transceiver 20, respectively. Whenever microprocessor 12 wishes to place address information on address bus 14, it generates a binary signal corresponding to the desired address on its output ports A1–A19 (for reasons which will be described below, output port A0 is not used for address purposes) and generates the address latch enable signal ALE which is applied to the strobe input STB of address latch 18. This causes the 19 bit address signal generated by microprocessor 12 to be placed on address bus 14. Since the output enable input $\overline{OE}$ of address latch 18 is grounded, the 19 bit address applied to the input of address latch 18 will remain on address bus 14 until a new address is strobed into latch 18. One suitable address latch is manufactured by Intel Corporation under the product designation 8282 Octal latch. While a single latch 18 is shown, it will be apparent to those skilled in the art that three latches must be used in parallel to latch all 19 outputs of microprocessor 12.

The 16 least significant bits of the address signal are contained on address lines A1–A16 of address bus 14 and are used to address the memory elements 22–28 of system 10. The three most significant bits of the address signal are contained on address lines A17–A19 and are applied to a one of eight decoder 32 which is used to generate chip enable signals which enable only one of the memory elements 22–28 at any given time. One suitable decoder is manufactured by Intel Corporation under the product designation 8205 one of eight decoder. Decoder 32 receives the three lines A17–A19 on its address inputs A0–A2, respectively, and causes that one of its eight outputs 00–07 (only outputs 00–04 are used in system 10) to be set. Thus, if the binary signal 000 is applied to the inputs of decoder 32, its output 00 will be set (will be placed at the binary "0" level) while the remaining outputs will be reset (will be at the binary "1" level). Similarly, when the binary address signal 001 is applied to the input of decoder 32, its output 01 will be set and the remaining outputs will be reset. In this manner, decoder 32 can generate chip enable signals $\overline{E1}$, E2 (the 01 output of decoder 32 is inverted by an inverter 34), $\overline{E3}$, $\overline{E4}$, $\overline{E5}$ and E6 (the 02 output of decoder 32 is inverted by an inverter 35).

Once the appropriate address has been placed on address bus 14, microprocessor 12 can either write data onto data bus 16 or read data on the data bus 16 into its internal memories. This is accomplished through the use of a transceiver 20 which may be a 8286 Octal Bus Transceiver manufactured by Intel Corporation.

In the system 10 described herein, all information is transmitted as either a 1, 11 or 16 bit word. For this reason, only output lines A0–A15 of microprocessor 12 are applied to transceiver 20. Transceiver 20 applies the 16 bits of data contained on the output ports A0–A15 of microprocessor 12 onto data bus 16 whenever the data enable signal $\overline{DEN}$ is applied to its output enable input $\overline{OE}$ and the data transmission signal $DT/\overline{R}$ is at the binary "1" level. When the data enable signal $\overline{DEN}$ is generated but the data transmit signal $DT/\overline{R}$ is at the binary "0" level, data contained on bus 16 will be applied to ports A0–A15 of microprocessor 12 and will thereby be read into the internal memory of microprocessor 12. Since the 8286 transceiver is an octal transceiver, two transceivers must be connected in parallel to handle all 16 data bits.

Microprocessor 12 controls the operation of font display and text editing system 10 by following a software program stored in program ROM 22. The software program, which will be described below with reference to the flow diagrams of FIGS. 5–12, is stored in program ROM 22 in machine code as a plurality of 16 bit words. Microprocessor 12 will sequence through the various steps of its program by periodically requesting new program instructions from program ROM 22 at time intervals determined by clock pulses generated by system clock 36. Each time microprocessor 12 needs a new program instruction, it applies that address signal to lines A1–A16 of address bus 14 which identifies the storage location of the desired program instruction, causes decoder 32 to generate the chip enable signal $\overline{E1}$ and generates the read signal $\overline{RD}$. As a result, a 16 bit word containing the desired program instruction(s) will appear on data bus 16. Microprocessor 12 then reads this instruction into its internal memory via transceiver 20.

While any available memory can be used, one suitable program ROM 22 is an 8K×8 UV erasable PROM sold under the product designation 2764 PROM by Intel Corporation. Since each PROM can store only 8 bits of information, two PROMS are connected in parallel so that a single address generated by microprocessor 12 is applied to the address inputs of both PROMS and the 8 bits outputs of each PROM are combined to form a single 16 bit word which is applied to data bus 16.

Following the program instructions contained in program ROM 22, microprocessor 12 will cause system 10 to display the shape of specific font characters which are identified by a character code generated by an input device (preferably the electronic keyboard described below) 38 on a display device (preferably a CRT) 40 with sufficient resolution to permit the user of the system to view an accurate representation of what will appear on the final printed page. In order to attain satisfactory results, it is preferable that the CRT 40 have a resolution of between 800 to 1,100 lines, each divided into between 800 and 1,100 pixel (picture element) locations. Each pixel should be small, on the order of 0.01 inches in diameter, so that the individual characters which are formed by a combination of pixel dots will appear to be smooth and continuous.

In the embodiment disclosed herein, the CRT 40 is divided into 1,024 lines each containing 1,024 pixel locations. This division of the CRT is illustrated graphically in FIG. 2 wherein each box 42 represents a single pixel location. It will be understood by those skilled in the art that the grid lines shown in FIG. 2 will not actually appear on the CRT 40 but are only shown for purposes of explanation. The grid lines merely define areas on the CRT 40 which represent the pixel locations 42. As the electron beam scans the face of the CRT 40, it is modulated in a manner which causes it to excite certain pixel locations 42 but not others. Those pixel locations 42 excited by the electron beam will fluoresce (producing a pixel 44) so as to form the character desired.

In the embodiment disclosed herein, CRT 40 is divided into 64 rows by 64 columns of character cells 46, each of which is 16 pixels wide and 16 pixels deep high. A single character can be formed in each character cell 46 so that the CRT 40 can display up to 64×64=4,096 characters. This represents a single page of text.

While a character cell 46, having constant dimensions of 16×16 pixels, is disclosed, it should be understood that the invention is not so limited. Thus, character cells of other sizes may also be used. Additionally, it is not necessary that the size of the character cell remain constant, i.e., one character may be stored in a cell 20×16 pixels while a second character may be stored in a cell 28×18 pixels. Alternatively, the character cell size can remain constant, but characters can be stored in less than and/or more than one cell. While such variations complicate the design of the system, such design modifications are well within the skill of those of ordinary skill in the art.

A character may be displayed in any given character cell 46 by energizing selected pixel locations 42 in that cell. The particular pixel locations 42 which must be energized to form a desired character are defined by a unique set of 16 binary words (hereinafter data words), each 16 bits in length. Each set of 16 data words describes the shape of the character to be displayed and will be referred to hereinafter as character set.

Figures 3A, 3B:
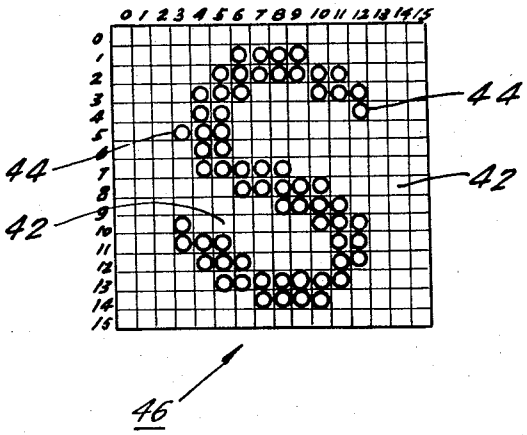
FIG. 3A is a schematic representation illustrating the manner in which a character may be formed by a plurality of pixels located in a character cell.
FIG. 3B illustrates the binary words which may be used to define the character illustrated in FIG. 3A.

The preferred relationship between the individual words of the character set and the individual pixel locations 42 of a character cell 46 may best be understood with reference to FIGS. 3A and 3B. FIG. 3A illustrates a single character cell 46 containing the letter "S". FIG. 3B shows the 16 data words of the character set defining the letter "S". As shown in FIG. 3A, the letter "S" is formed by a plurality of pixels 44, each of which is located in a respective pixel location 42. Since pixel row 0 of the character cell 46 contains no pixels 44, data word 1 (FIG. 3B) of the character set is represented by the binary number: 0000000000000000. Since pixel row 1 contains pixels 44 at the four pixel locations 42 corresponding to pixel columns 6, 7, 8 and 9, data word 2 is stored as: 000000111100000. This sequence continues through to data word 16 such that the 16 data words of the character set contain all the information required to produce a single character in a single character cell 46. Using this technique, any shape character may be described by a unique character set of 16 data words each 16 bits in length.

Since the shape of a character to be displayed on CRT 40 may be defined by a 16 word character set, the shape of the characters displayed is limited only by the size of the font ROM memory 24 in which the character sets are stored and the resolution of a 16×16 pixel character cell. This provides tremendous flexibility which makes it possible to store a large number of font styles and call up any character of any font style onto the CRT 40 by merely entering appropriate commands in the input device 38. Once the user of system 10 has entered the desired characters, he may then rearrange the position of the characters on the CRT 40 utilizing any text editing capabilities available. As a result, the user is presented with an accurate representation of what will appear on the final printed page.

By way of simple example, the user may call up the characters:

SHEM in Hebrew is שם.

In this example, characters from two fonts (a bold Roman font and Hebrew font) have been called up from font ROM 24 onto the CRT 40. After entering this text data, the user may decide it is desirable to write the word SHEM in a second style of font so as to offset the name from the rest of the sentence. In a manner described in detail below, the user will then cause system 10 to replace the bold Roman characters of the word SHEM with characters from a different style font, for example, Roman script. This is done by writing the script letters *SHEM* over the bold letters SHEM. As a result, the following words will appear on CRT 12:

*SHEM* in Hebrew is שם.

In the following description of font display and text editing system 10, it will be assumed that three font styles ROMAN 1 (a bold Roman type), ROMAN 2 (a script Roman type) and HEBREW are stored in font ROM 24. It should be recognized, however, that a greater number of font styles (as well as different font styles) may be stored.

In the presently preferred embodiment, each font style includes 128 characters comprising the upper and lower case letters of the alphabet, punctuation marks, a blank space and any other characters which are to be displayed on the CRT 40. The font style ROMAN 1 will contain the Roman characters necessary for the English language in a first style, for example, bold. The font ROMAN 2 will also contain the Roman characters for the English language, but in a second style, for example, script. The font HEBREW will contain the various Hebrew letters in a desired style.

Each character of the three fonts is assigned a unique character code which identifies the address locations of the 16 word character set defining the character in font ROM 24. Since each font contains 128 characters, 128×3=384 character codes are required. These codes may be expressed as a 9 bit binary word. For example, the lower case letter "a" of the character font ROMAN 1 can be accorded the character code 0 (binary 000000000), the lower case letter "b" of the character font ROMAN 1 can be accorded the character code 1 (binary 000000001), etc. Similarly, the lower case letter "a" of the character font ROMAN 2 can be accorded the character code 128 (binary 010000000), the lower case letter "b" of character font ROMAN 2 can be accorded the character code 129 (binary 010000001), etc. In a similar manner, the lower case letter "aleph" of the character font HEBREW can be accorded the character code 256 (binary 100000000), the lower case "bet" of the character font HEBREW can be accorded the character code 257 (binary 100000001), etc.

In accordance with the foregoing, the 16 words of each character set are preferably stored in ROM memory 24 in the order determined by the character code identifying that character. Thus, the 16 word character set defining the lower case letter "a" of the character font ROMAN 1 is stored at address locations 0–15 of memory 20 while the 16 words of the character set defining the lower case letter "b" of the character font ROMAN 1 is stored at address locations 16–31 of memory 20. All 128 character sets of character font ROMAN 1 are in the first 128×16=2,048 address locations (numbered 0–2,047) of font ROM 24. The 128 character sets of character font ROMAN 2 are stored at address locations 2,048–4,095 of font ROM 24. Particularly, the 16 word character set describing the lower case "a" of character ROMAN 2 font is stored at address locations 2,048–2,053, while the 16 word character set describing the lower case "b" of character ROMAN 2 font is stored at address locations 2,054–2,069, etc. Finally, the 128 character sets defining the font HEBREW are stored at address locations 4,096–6,143 of font ROM 24. Particularly, the character set describing the lower case "aleph" of the font HEBREW is stored at address locations 4,096–4,111; the character set describing the lower case "bet" is stored at address locations 4,112–4,127, etc.

The 9 bit character codes identifying the address locations of the 16 word character sets in font ROM 24 are generated by an input device 38 which may take any known form. In the preferred embodiment, input device 38 is an electronic keyboard and will be described as such. It should be recognized, however, that any other input device (for example, one utilizing menu selection techniques or one responsive to voice actuation) could also be used.

Figure 13:
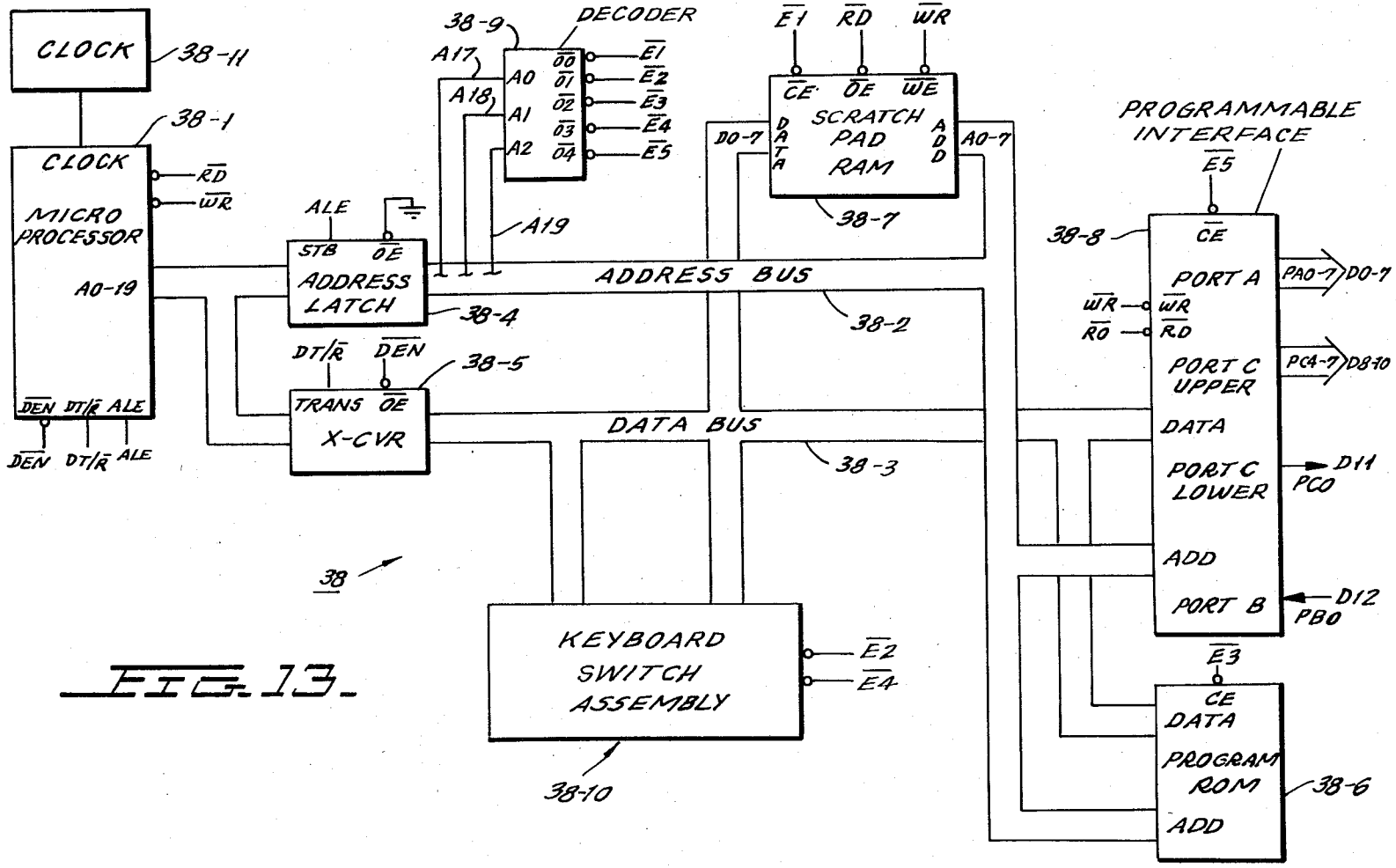
FIG. 13 is a schematic diagram of the programmable keyboard of FIG. 1.
Figure 14:
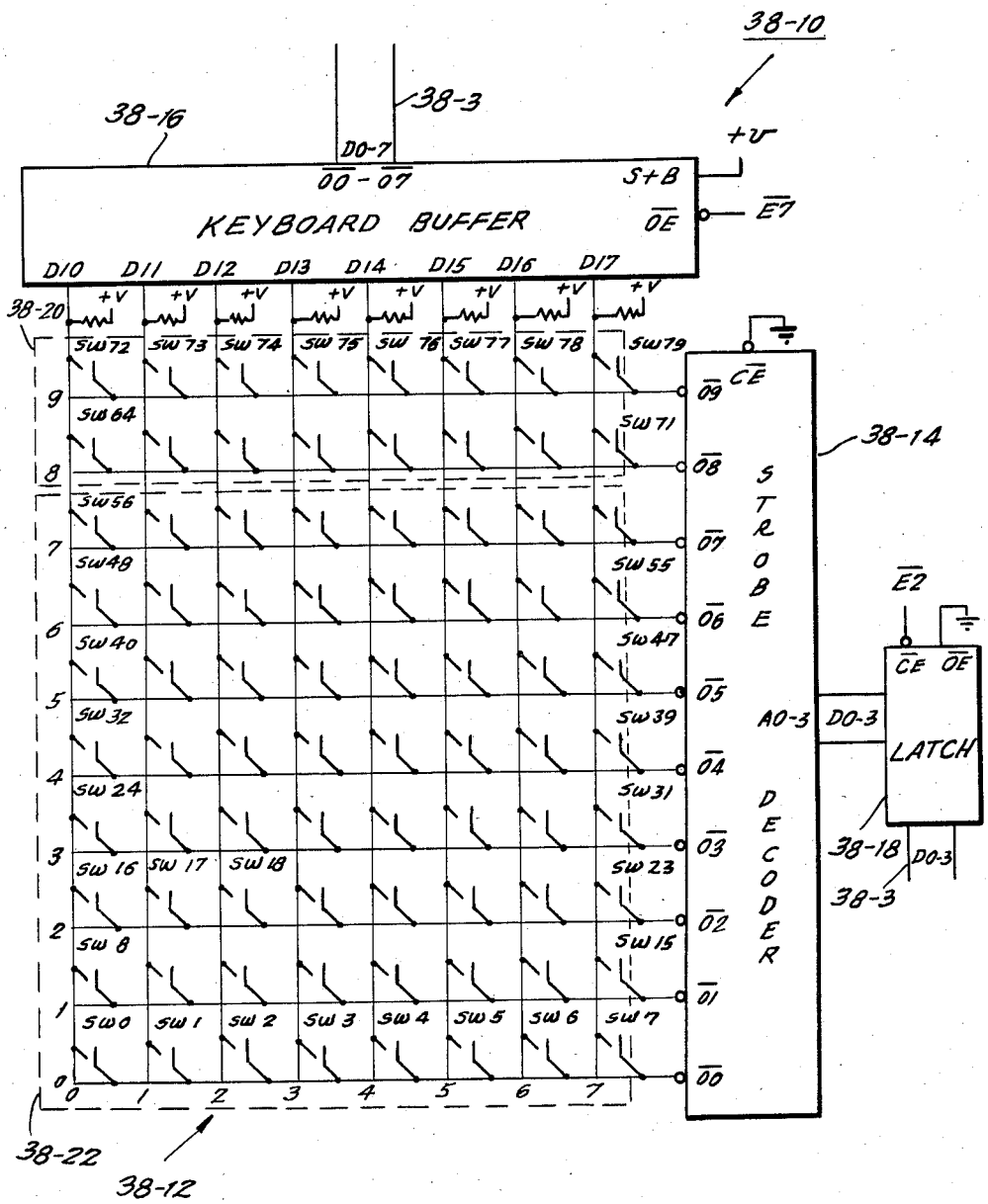
FIG. 14 is a schematic diagram of the keyboard switch assembly of FIG. 13.

The keyboard 38 preferably takes the form illustrated in FIGS. 13 and 14. This keyboard includes both character and command keys. The character keys may be used to identify the characters to be displayed on CRT 40 while the command keys will identify both the font style in which the character is to be displayed as well as standard command functions such as cursor left, cursor right, carriage return and backspace, etc. The command keys can also be used to define each character key as either a base character key or an overlay character key. The keyboard 38 responds to the depression of character and/or command keys by generating an 11 bit keyboard instruction which comprises a 2 bit format block filed by a 9 bit data block. Keyboard 38 can generate three types of keyboard instructions: base character codes, overlay character codes and command codes. The format block identifies which type of code the keyboard instruction contains. The data block identifies the specific command instruction or the character code of the base or overlay character.

In the embodiment disclosed herein, the presence of the bits 00 in the format block identify the keyboard instruction as a base character code, the presence of the bits 01 in the format block identify the keyboard instruction as an overlay character code, and the presence of the bits 11 in the format block identify the keyboard instruction as a command code.

As will be described in further detail below, font display and text editing system 10 forms complex characters (characters including both a base character and one or more diacritics such as the complex character "ä") onto the CRT 40 by first writing the base character onto the CRT and then writing the overlay character onto the CRT. Whenever system 10 is to display a complex character on CRT 40, it must first receive a keyboard instruction corresponding to the base character followed by a keyboard instruction corresponding to the overlay character. The manner in which these successive keyboard instructions are generated is described in some detail below. It is sufficient at this time to note that a plurality of keyboard instructions must be generated for each complex character which appears on the CRT 40.

Microprocessor 12 periodically strobes the output of keyboard 38 to determine if a new keyboard instruction has been generated. This is done using the following handshaking routine.

Whenever microprocessor 12 is ready for a new keyboard instruction, it places a binary "1" on line D12 of data bus 16 and causes decoder 32 to generate the chip enable signal E6. This causes a binary "1" to appear at PORT B of programmable interface 38-8 (see FIG. 13 and the discussion below) which informs the keyboard 38 that microprocessor 12 is ready for a new keyboard instruction. In response to this signal, keyboard 38 places an 11 bit keyboard instruction on data lines D0–D10 of data bus 17 and places a binary "1" on line D11 of data bus 17 once the keyboard instruction is ready to be transmitted. Microprocessor 12 repeatedly strobes latch 30 (by causing decoder 32 to generate the chip enable signal E2) and waits for the bit on line D11 to be at the binary "1" level. When it is, microprocessor 12 knows that the keyboard 38 has generated a new keyboard instruction. At this time, microprocessor 12 reads the keyboard instruction into its internal register A. Finally, microprocessor 12 puts a binary "0" on data line D12 of data bus 16 and strobes handshaking latch 31 so as to inform keyboard 38 that it is no longer ready to receive a new keyboard instruction. This completes the handshaking routine. When microprocessor 12 is ready to receive an additional keyboard instruction, it places a binary "1" on line D12 of data bus 16 and reinitiates the handshaking routine.

Since latch 30 receives 12 bits of data, it may be formed from two parallel connected 8282 Octal latches. Latch 31 may be formed from a single 8282 Octal latch.

When the keyboard instruction generated by keyboard 38 is a character code, microprocessor 12 determines where in font ROM 24 the 16 word character set identified by that character code is located and causes the 16 words of the character set to be placed in display RAM 26. Display RAM 26 then causes this character to be generated in the appropriate character cell 46 of CRT 40.

As noted above, each data word of each character code stored in ROM memory 24 is 16 bits in length. A font ROM 24 constructed of commercially available devices such as those described above with reference to program ROM 22 can store these data words at sequential locations. Whenever microprocessor 12 wishes to read a data word of the selected character set from font ROM 24, it places the appropriate address on lines A1–A16 of address bus 14, causes decoder 32 to generate the chip enable signal $\overline{E4}$ and simultaneously generates the read signal $\overline{RD}$. This will cause the 16 bit data word to appear on bus 16 which can then be read into an internal memory of microprocessor 12. This data word is then transferred to the appropriate storage location in display RAM 26 by placing the appropriate address signal on lines A1–A16 of address bus 14 and placing the data received from font ROM 24 on lines A0–A15 of data bus 16. At the same time that the address and data information is placed on the address and data buses 14, 16, microprocessor 12 will simultaneously cause decoder 32 to generate the chip enable signal $\overline{E5}$ and also generate the write signal $\overline{WR}$. This causes display RAM 26 to read the 16 bit data word on bus 16 into the address storage location identified by the address on bus 14. At certain times, it is necessary for microprocessor 12 to read specific data words out of display RAM 26. This is accomplished by placing an appropriate address on address bus 14, causing decoder 32 to generate the chip enable signal $\overline{E5}$ and simultaneously generating the read signal $\overline{RD}$.

Figure 4:
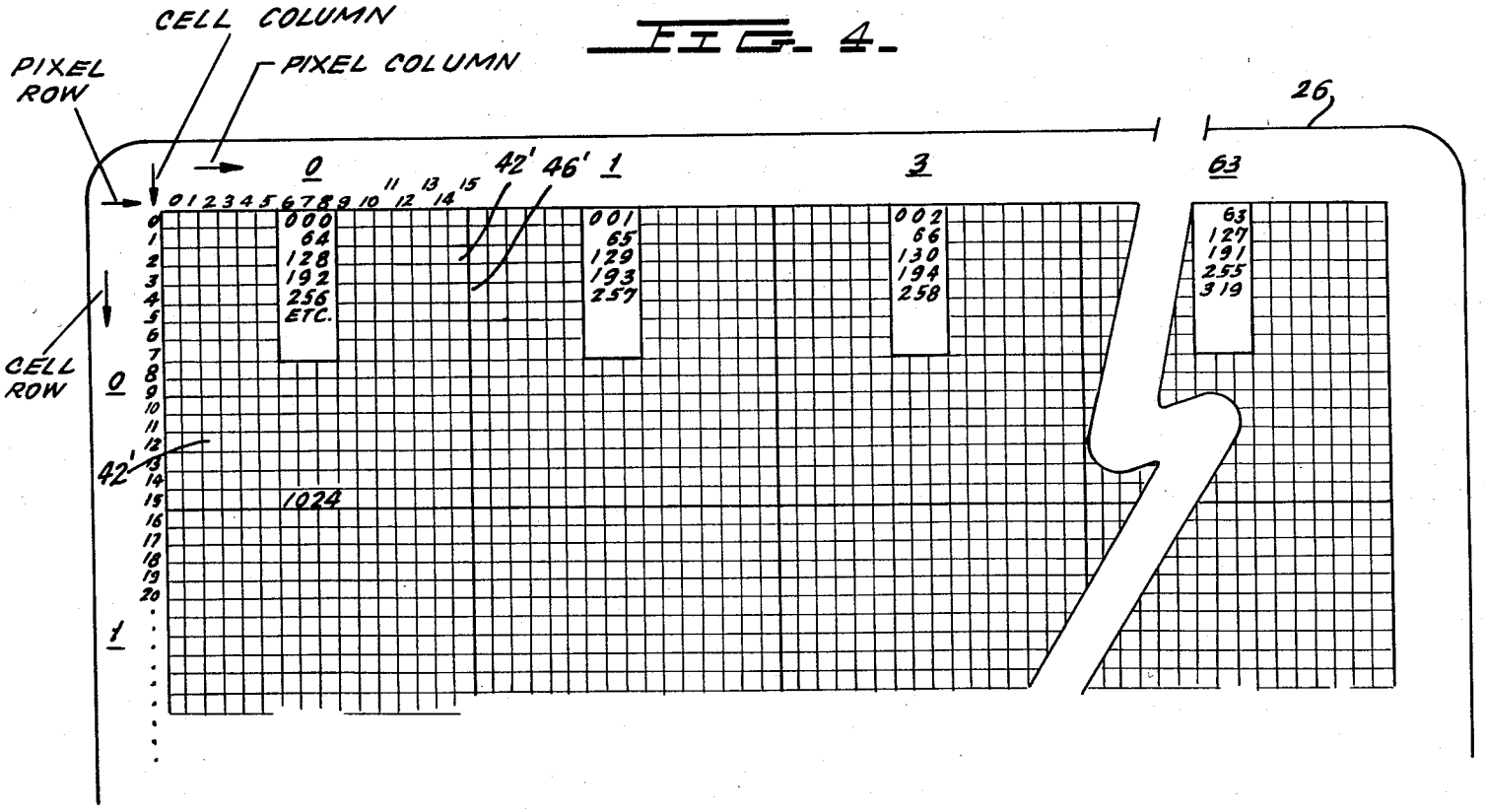
FIG. 4 is a schematic representation of the display RAM of FIG. 1.

As shown in FIG. 4, the display RAM 26 is broken up into 1,024×1,024 pixel locations 44′ which correspond on a one-to-one basis to pixel locations 44 on the CRT 40. One commercially available unit which incorporates the bit mapped display RAM, the CRT display and the necessary drive circuitry to cause the pixel information stored in the display RAM to be reproduced on the display is a model GMDM-1000 bit mapped high resolution CRT display manufactured by Image Automation Inc. The 16 bit data words read from font ROM 24 are written into display RAM 26 16 bits at a time. As such, 16 consecutive pixel locations 44' define a single address location of display RAM 26. Consecutive address locations are located adjacent one another in a pixel row. Thus, address location 000 is the first storage location in pixel row 0, address location 001 is the second storage location in pixel row 0, etc. Since the RAM memory 26 is 1,024 pixels wide, and since each word is 16 pixels in length, each pixel row of display RAM 26 contains 64 data words at address locations 000–063. The 64th data location is located at the leftmost end of pixel row 1 with 64 data words being stored at address locations 63–127 of row 1. In a similar manner, 64 data words will be stored in each of the 1,024 pixel rows of display RAM 26.

The memory space of display RAM 26 is logically divided into character cells 46' which correspond on a one-to-one basis to character cells 46 of CRT 40. Thus, the character cell 46' located in the upper left-hand corner of display RAM 26 corresponds to the character cell 46 located in the upper left-hand corner of CRT 40. In accordance with this protocol, the character cell 46' located in the upper left-hand corner of display RAM 26 will contain the 16 word character set which defines the character to be displayed in the upper left-hand character cell 46 of CRT 40. The 16 data words of the character set are stored at storage locations 0, 64, 128, 192 . . . 1,024 of display RAM 26.

Display RAM 26 will automatically apply appropriate biasing signals (e.g., vertical sync, horizontal sync and data stream) to the CRT 40 so as to cause the CRT 40 to display the character information stored in display RAM 26. Thus, as information is written into display RAM 26, it is, for practical purposes, simultaneously displayed on CRT 40.

Figure 2:
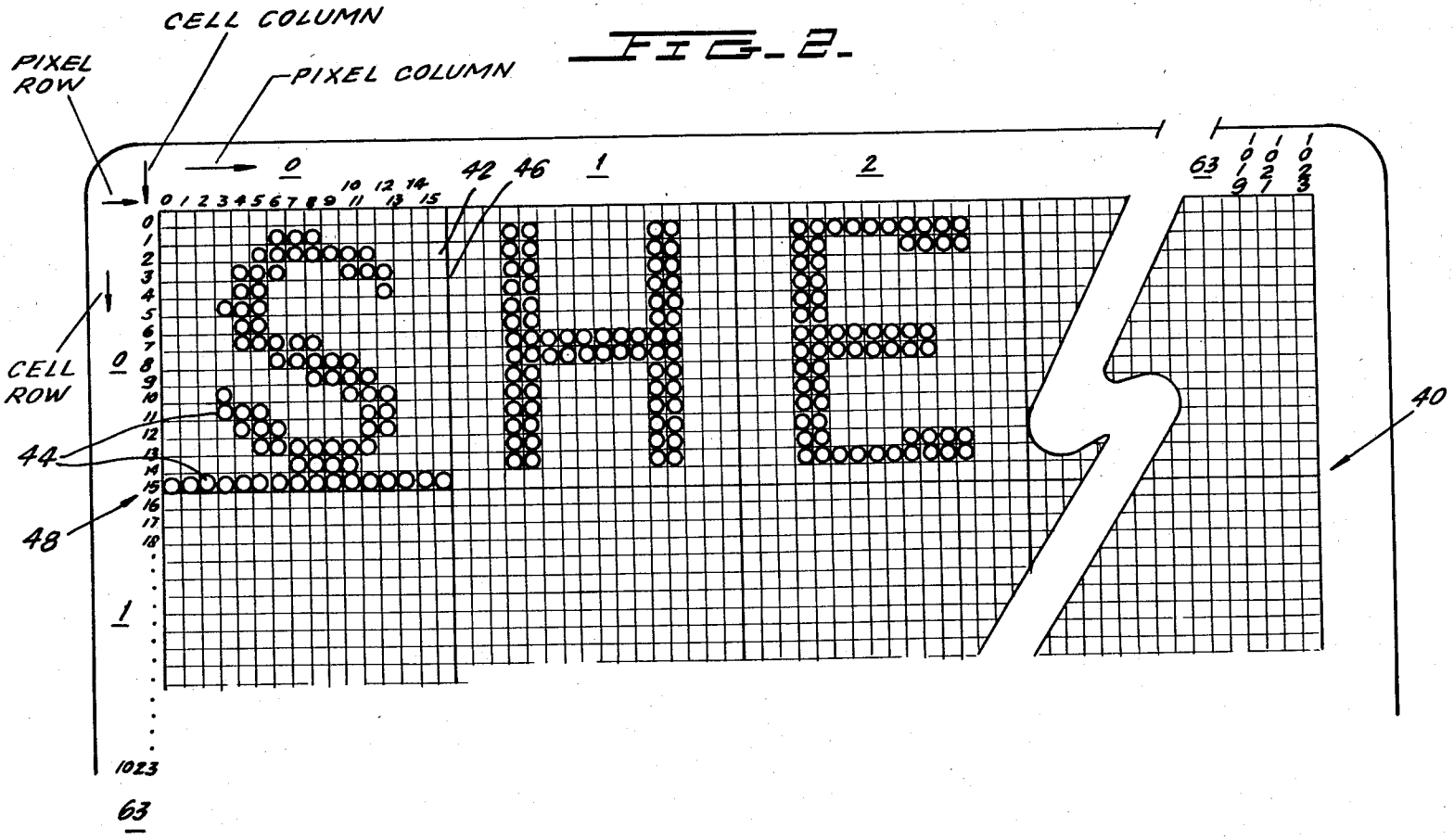
FIG. 2 is a schematic representation of the CRT of FIG. 1.

In order to identify the particular character cells 46, 46' in both CRT and display RAM 26, both CRT 40 and display RAM 26 are logically broken up into 64 cell columns and 64 cells rows. Referring to FIGS. 2 and 3, the cell columns are numbered 0–63 as are the cell rows. As such, each character cell 46, 46' has a unique set of coordinates. For example, the letter "S" illustrated in FIG. 2 is displayed in the character cell 46 located at cell row 0, cell column 0; the letter "H" is displayed in the character cell 46 located at cell row 0, cell column 1, etc.

The character cell 46 in which the next character identified by the character code generated by keyboard 38 is to be placed will be referred to as the "active" character cell. Microprocessor 12 keeps track of the location of the active character cell by storing cell row and column pointers CR, CC, respectively, in scratch pad RAM 28. The microprocessor 12 identifies the location of the active cell to the user of system 10 by generating a cursor 48 in the active cell. In the preferred embodiment, cursor 48 takes the form of a line of pixels 44 located in the lowermost line of the active character cell 46. Each time keyboard 38 generates a new character code identifying a character to be placed in the active character cell, microprocessor 12 moves the cursor 48 one character cell 46 to the right. When the cursor is located in the last character cell 46 in a given row, microprocessor 12 moves the cursor to the leftmost character cell 46 of the next cell row.

In the embodiment disclosed herein, the location of the active cell, and therefore the position of cursor 48, can also be moved to the left or to the right in response to cursor left or cursor right command signals, respectively. If desired, cursor up and cursor down command signal could also be provided as well as any other cursor movements common to text editing and photocomposing apparatus. When the position of is changed in response to cursor left or cursor right commands, cursor 48 is moved without causing the character located in the character cells 46 traversed by cursor 48 to be removed from CRT 40. In contrast, when the cursor 48 is moved to the left or to the right in response to space or backspace commands, the characters stored in the character cells 48 traversed by cursor 48 will be erased by microprocessor 12. The position of the cursor 48 can also be changed in response to a carriage return command signal generated by keyboard 38. In this case, microprocessor 12 causes the cursor to be moved to the leftmost character cell 46 in the next succeeding cell row. Again, movement of the cursor 48 into this new character cell 46 will not cause the character stored in the cell 46, if any, to be erased.

As noted above, microprocessor 12 periodically strobes keyboard latch 30 to determine if a new keyboard instruction has been generated by keyboard 38. Microprocessor 12 enters new character information in display RAM 26 and/or move the location of the cursor 48 in response to these instructions. Microprocessor 12 also stores each keyboard instruction generated by keyboard 38 which is a base or overlay character, including blank characters and a character identifying a carriage return command in text buffer and scratch pad RAM 28 at a memory location corresponding to the character cell 46' in which the character identified by that keyboard instruction is stored. In this manner, text buffer and scratch pad RAM 28 contains keyboard instructions corresponding to all of the characters stored in display RAM 26.

While any appropriate memory can be used for text buffer and scratch pad RAM 28, one suitable memory is an 8,192×8-bit integrated RAM which is sold by Intel Corporation under the product designation 2186 RAM. Since each 2186 RAM stores 8 bit words, and since microprocessor 12 places either 11 or 16 bit words into RAM 28, two 2186 RAMs must be connected in parallel. Both address inputs of the 2186 RAMs will receive address lines A1–A16 of address bus 14 while the data output of one of the RAMs will be connected to the data lines A0–A7 and the data outputs of the remaining RAM will be connected to the lines A8–A15 of data bus 16.

The information stored in RAM 28 can be used to refresh the memory in display RAM 26 whenever necessary. Additionally, once an entire page of information has been stored in display RAM 26, it must be cleared to enter a new page of information. At this time, the keyboard instruction stored in text buffer and scratch pad RAM 28 may be transferred to a larger, more permanent mass memory (not shown) such as a floppy disk or hard disk. In this manner, keyboard instructions for a plurality of pages may be stored in the mass memory. This information may be recalled at any time and may be also used to transfer keyboard instruction to a phototypesetter which creates photographic negatives of a printing plate from this information. The phototypesetter will contain font information corresponding to that stored in font ROM 24 so that the characters produced by the phototypesetter take substantially the same shape as those displayed on CRT 40. While the manner in which information is transferred from text buffer and scratch pad RAM 26 to the mass memory is not described herein, such information transfer procedures are well known to those of ordinary skill in the art. Exemplary mass storage media and methods for transferring information from a temporary memory to such media are described in the SYSTEMS DATA CATALOG, dated January 1982, and published by Intel Corporation. The disclosure of this catalogue is incorporated herein by reference.

As noted above, the system 10 of the present invention creates complex characters on the CRT 40 by having keyboard 38 generate a plurality of keyboard instructions, i.e. a base character keyboard instruction followed by one or more overlay character keyboard instruction. As a result, a plurality of keyboard instructions can be associated with each of the character cells 46' of the display RAM 26. Since each of the keyboard instructions generated by keyboard 38 must be stored in text buffer and scratch pad RAM 28, the storage locations in RAM 28 will not correspond on a one-to-one basis to the character cells 46' in the display RAM 26. For this reason, microprocessor 12 maintains a pointer variable TBP in text buffer and scratch pad RAM 28 which keeps track of the address location in RAM 28 of the first keyboard instruction associated with the active character cell at the end of each instruction routine.

The purpose of the text buffer pointer TBP can best be understood by way of illustration. It will be assumed that a blank character is contained in the character cell 46' corresponding to row 0, column 0, that the character "s" is stored in the character cell 46' corresponding to column 0, row 1, that the complex character "ä" is stored in the character cell 46 corresponding to row 0, column 2, and that the base character "t" is stored in the character cell 46' corresponding to row 0, column 3. In such a base, the keyboard instruction corresponding to a blank character is stored in the first storage location of the text buffer portion of RAM 28 (this will be assumed to be the location zero), the keyboard instruction corresponding to the base character "s" will be stored in the second storage location (location one) of RAM 28, the keyboard instruction corresponding to the base character "a" will be stored in the third storage location (location two) of the RAM 28, the keyboard instruction for the overlay character " .. " will be stored in the fourth storage location (location three) of RAM 28, and the base character "t" will be stored in the fifth storage location (location four).

If it is assumed that the active cell 46 is located at row 0, column 0, the text buffer pointer TBP will equal zero. If the user hits the cursor right command key so that the cell 46 corresponding to row 0, column 1, is the active cell, the text buffer pointer TBP will equal one. If the user again hits the cursor right key so as to make the cell 46 at a column 0, row 2, the active cell, the text buffer pointer TBP will equal two (the location of the first keyboard instruction corresponding to the complex character stored in that cell). If the user again hits the cursor right key so as to make the character cell 46 corresponding to row 0, column 3, the active cell, the text buffer pointer TBP will be stepped up by two and will now equal four which corresponds to the address location in RAM 28 of the first keyboard instruction associated with the character cell 46' in row 0, column 3. If the complex character in the cell 46' at row 0, column 2, had two overlays and was, therefore, associated with three keyboard instructions, the text buffer pointer would have been increased to five when the cell 46' at row 0, column 3, became the active cell. The manner in which the program stored in program ROM 22 keeps track of the text buffer pointer TBP is described below with reference to the software of FIGS. 5–12.

As will be described below, the program stored in ROM 22 permits the user to edit the text displayed on CRT 40 by moving the text around and/or by writing new text over the old text. In the foregoing example, the user may wish to replace the complex character "ä" with the base character "e". This could be done by depressing the cursor left or cursor right keys to place the cursor 48 in the cell 46 at row 0, column 2, so as to make the cell containing the character a the active cell. The user would then depress the key associated with the base character "e" with the result that the complex character "ä" would be erased and the base character "e" would take its place. In such a case, the two keyboard instructions (the base character "a" and the overlay character " .. ") would have to be removed from text buffer and scratch pad RAM 28 and it would be replaced by the single keyboard character corresponding to the base character "e". Since a single keyboard instruction has been substituted for a pair of keyboard instructions, each of the keyboard instructions stored in the text buffer and scratch pad RAM 28 at locations below the storage location corresponding to the character cell 46 at column 0, row 2, would have to be moved up by one storage location so as to maintain consistency between the text buffer pointer TBP and the information displayed on CRT 40. The software described below manipulates the information in RAM 28 accordingly.

The text can also be edited by adding a paragraph at any desired location in the text. For example, if an entire page of text has been entered and the user wishes to break a single paragraph into two paragraphs, he can move the cursor 48 to the position where he wants to begin the new paragraph and then depress the carriage return key. This will cause all of the characters to the right of the active character cell 46 to be removed from the row and replaced by blanks. The characters removed from the end of the row will be placed in the following row and all the text information below the row in which the carriage return character was inserted will be arranged in succeeding rows of the CRT display 40.

Since each of the characters in the row where the carriage return was inserted is replaced by a blank character, keyboard instructions corresponding to a blank character must be stored in the text buffer. Additionally, since the active cell is now in the first column of the next succeeding row, the text buffer pointer TBP must be advanced accordingly. The software carries these functions out automatically.

Before describing the software program stored in program ROM 22, a peculiarity of the 8086 microprocessor should first be discussed. As noted above, the least significant bit of the address generated by microprocessor 12 (which bit is located on output port A0) is not placed on address bus 14. As a result, the address actually received by memories 22–28 is equal to the address generated by microprocessor 12 divided by two.

As described in some detail in the "iAPX 86, 88 User's Manual", the 8086 microprocessor can access either 8 or 16 bits of memory at a time. Whenever the 8086 microprocessor wishes to access a 16 bit word in memory in a single bus cycle, it must generate an even number address (i.e., 2, 4, 6, . . . ) on its output ports A–A19. Whenever it generates an odd number address, the 8086 microprocessor must access the external memories one 8 bit byte at a time in two consecutive bus cycles. Since such 8 bit byte addressing is not required by the remaining elements of system 10, and since the use of 8 bit byte addresses complicates the design of the system 10, it is preferred that the microprocessor generate only even numbered addresses.

While it is preferable for microprocessor 12 to generate even number addresses, it would be wasteful not to use the odd address locations in the memories 22–28. This problem is simply solved by not connecting address line A0 (which contains the least significant bit of the address generated by microprocessor 12) to the address bus 14. The effect of the foregoing is that microprocessor 12 will generate even addresses only but the memory elements 22–28 of the system 10 will receive both odd and even addresses. Thus, the addresses 2, 4, 6, 8, etc. generated by microprocessor 12 will be applied to address bus 14 as addresses 1, 2, 3, 4, etc.

Figure 5A:
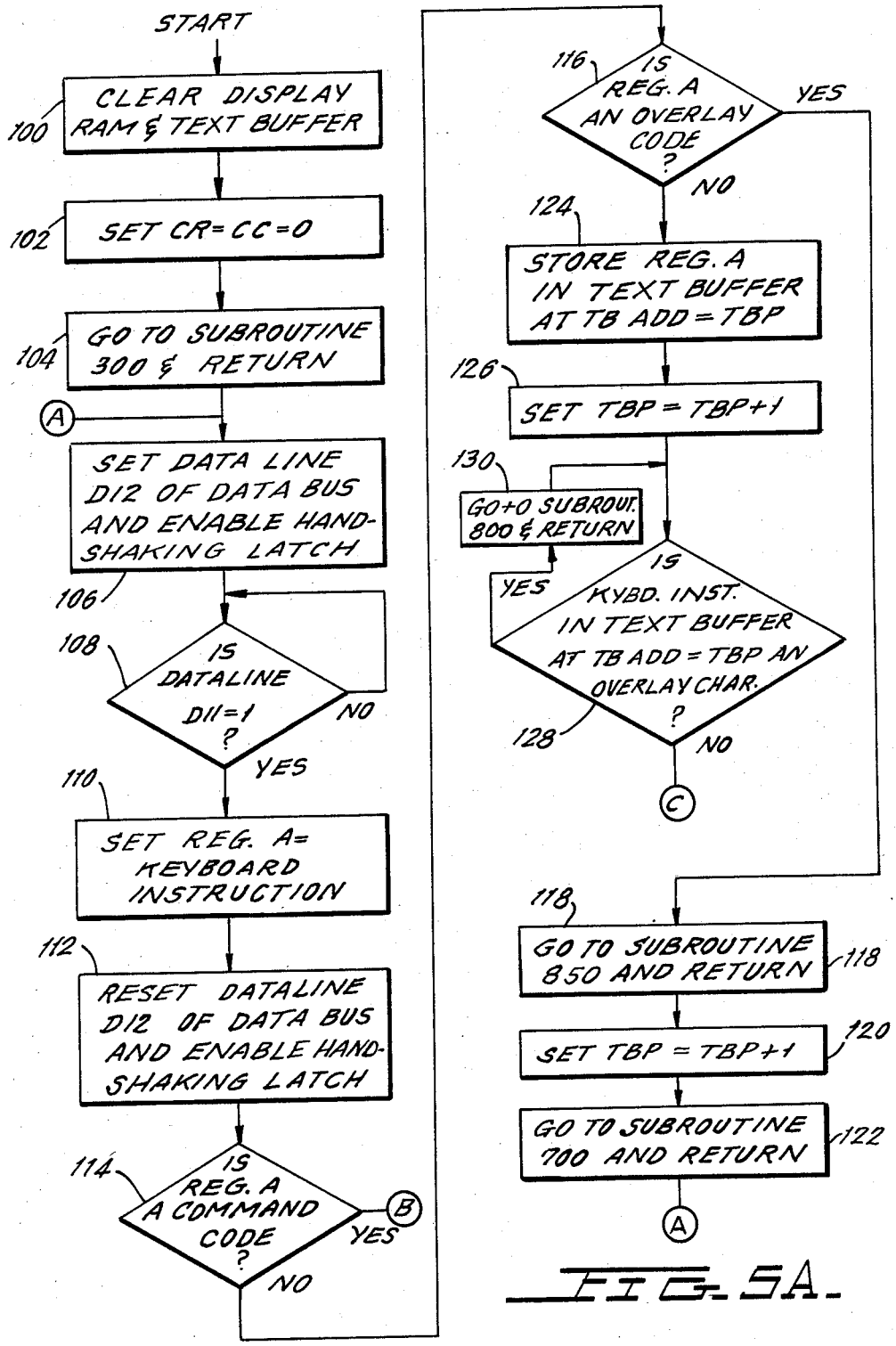
FIGS. 5A, 5B 5C and 5D are flow diagrams illustrating the main system program stored in the program ROM of FIG. 1.
Figure 5B:
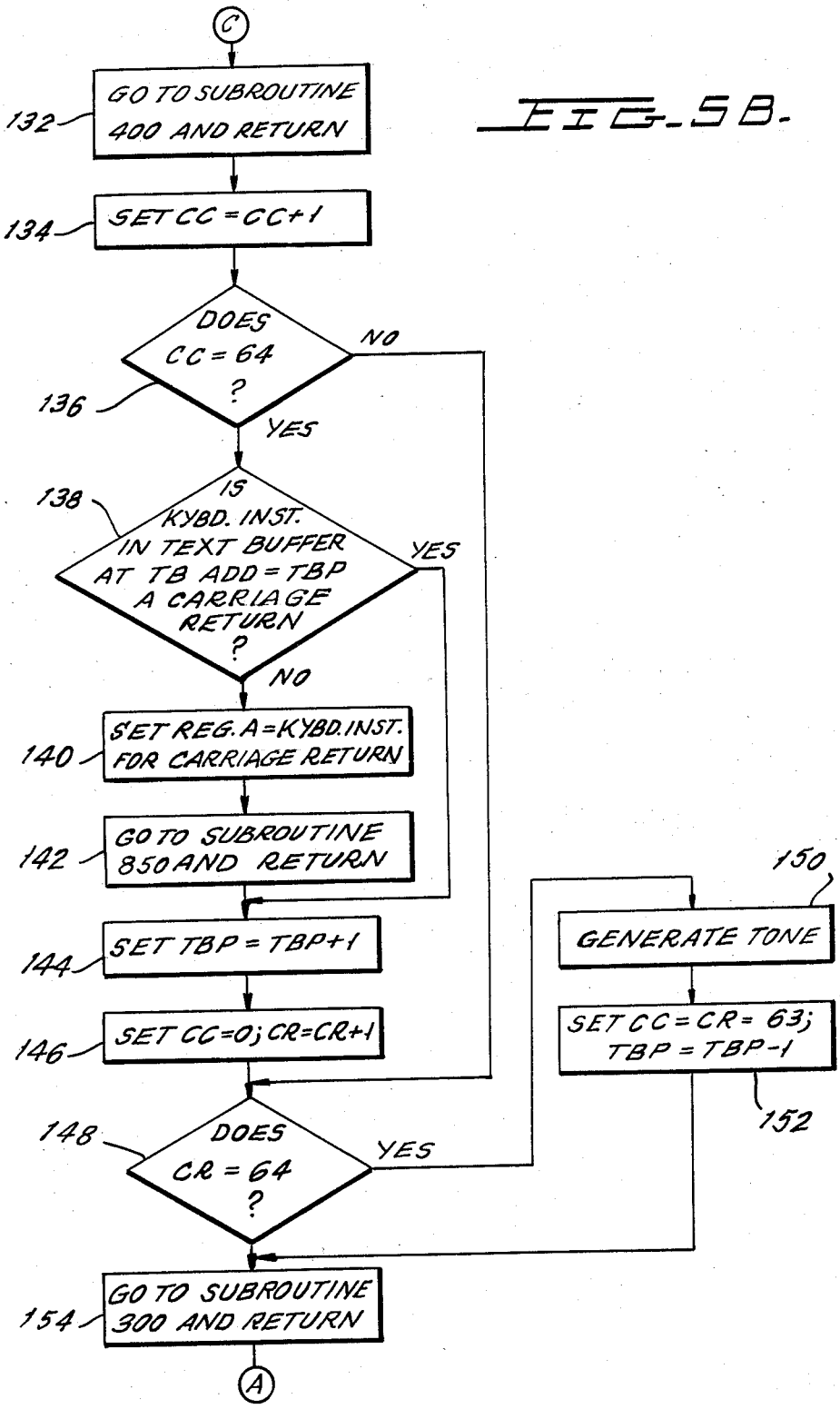

The operation of font display and text editing system 10 will now be described with reference to FIGS. 5–7 which show the program stored in program ROM 22 in flow chart form. The main program is illustrated in FIGS. 5A, B and C. Two subroutines are illustrated in FIGS. 6 and 7.

The main program starts at instruction block 100 which instructs microprocessor 12 to clear both display RAM 26 and text buffer and scratch pad RAM 28. At the same time, the character codes previously stored in text buffer 28 may be transferred to a larger, more permanent mass memory for later retrieval and ultimately for transfer to a phototype-setting machine. Once the RAMs 26 and 28 have been cleared, microprocessor 12 proceeds to instruction block 102 and sets the cell row pointer CR and cell column pointer CC to zero. These pointers define the character cell 46 located at the upper left-hand corner of CRT 40 as the active character cell.

Microprocessor 12 then proceeds to instruction block 104 which tells it to go to cursor subroutine 300 and return. Subroutine 300 causes a cursor 48 to be placed at the bottom of the active character cell 46 identified by pointers CR and CC.

Figure 6:
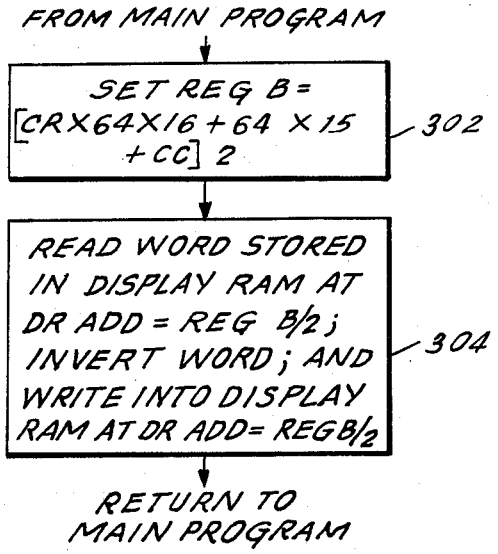
FIGS. 6, 7, 8, 9, 10, 11 and 12 are flow diagrams illustrating subroutines of the main system program illustrated in FIGS. 5A–5D.
Figure 7:
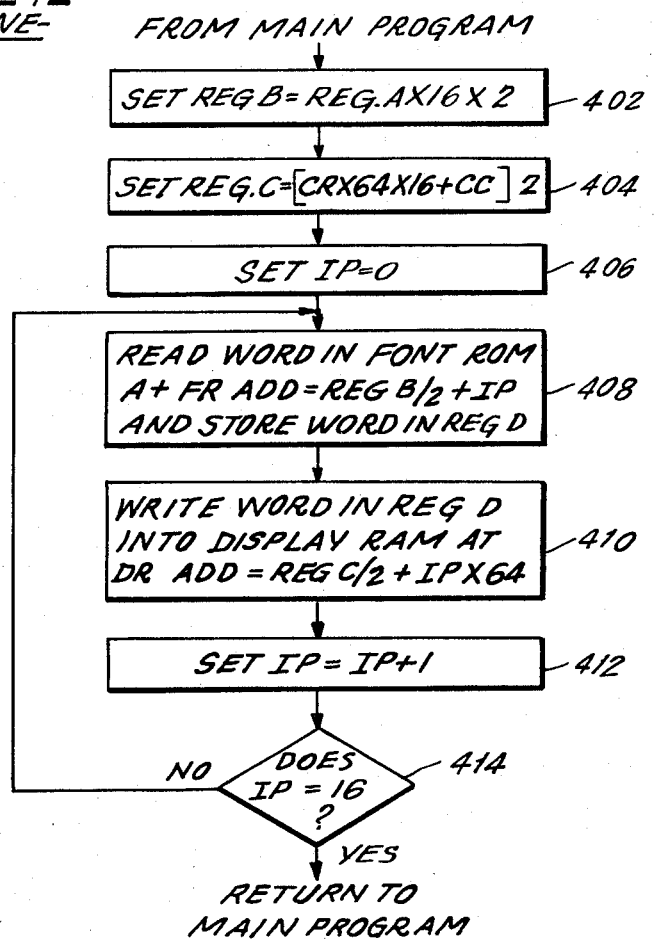

Referring to FIG. 6, instruction block 302 causes microprocessor 12 to sets its internal register B as follows:

$$REG\ B=[CR\times 64\times 16+64\times 15+CC]2 \qquad \text{Eq. 1}$$

Since there are $64\times 16$ storage locations in each cell row of display RAM 26, the terms of equation 1 which are located in brackets define the address of the last data word of the character cell 46' of display RAM 26 which corresponds to the active character cell 46 of CRT 40. This address is multiplied by two since the address generated by microprocessor 12 must be twice the address which appears on address bus 14 (it should be remembered that the least significant bit of the address generated by microprocessor 12 is not applied to address bus 14 since the output port A0 of microprocessor 12 is not connected to address latch 18).

Upon completion of the foregoing calculation, microprocessor 12 proceeds to instruction block 204 and reads the data word stored in display RAM 26 at the display RAM address DR ADD=REG B/2, inverts the word and writes the inverted word back into the display RAM 26 at REG B/2. The effect of the foregoing is that a cursor line 48 is placed at the bottom of the upper left-hand character cell 46 of CRT 40. At this point, microprocessor 12 returns to the main program.

Referring again to FIG. 5A, microprocessor 12 proceeds to instruction block 106 and sets the data line D12 of data bus 16 and enables the handshaking latch 31 so as to initiate the handshaking routine. Microprocessor 12 then continually polls data line D11 to determine if it is equal to one. See block 108. When it is equal to one, the keyboard 38 has indicated that it has a new keyboard instruction for the microprocessor 12. At this point, microprocessor 12 proceeds to instruction block 110 and sets its internal register A equal to the keyboard instruction appearing at the output of keyboard 38. Microprocessor 12 then resets data line D12 of the data bus 16 and enables latch 31 so as to inform keyboard 38 that it has received the new keyboard instruction.

Figure 5C:
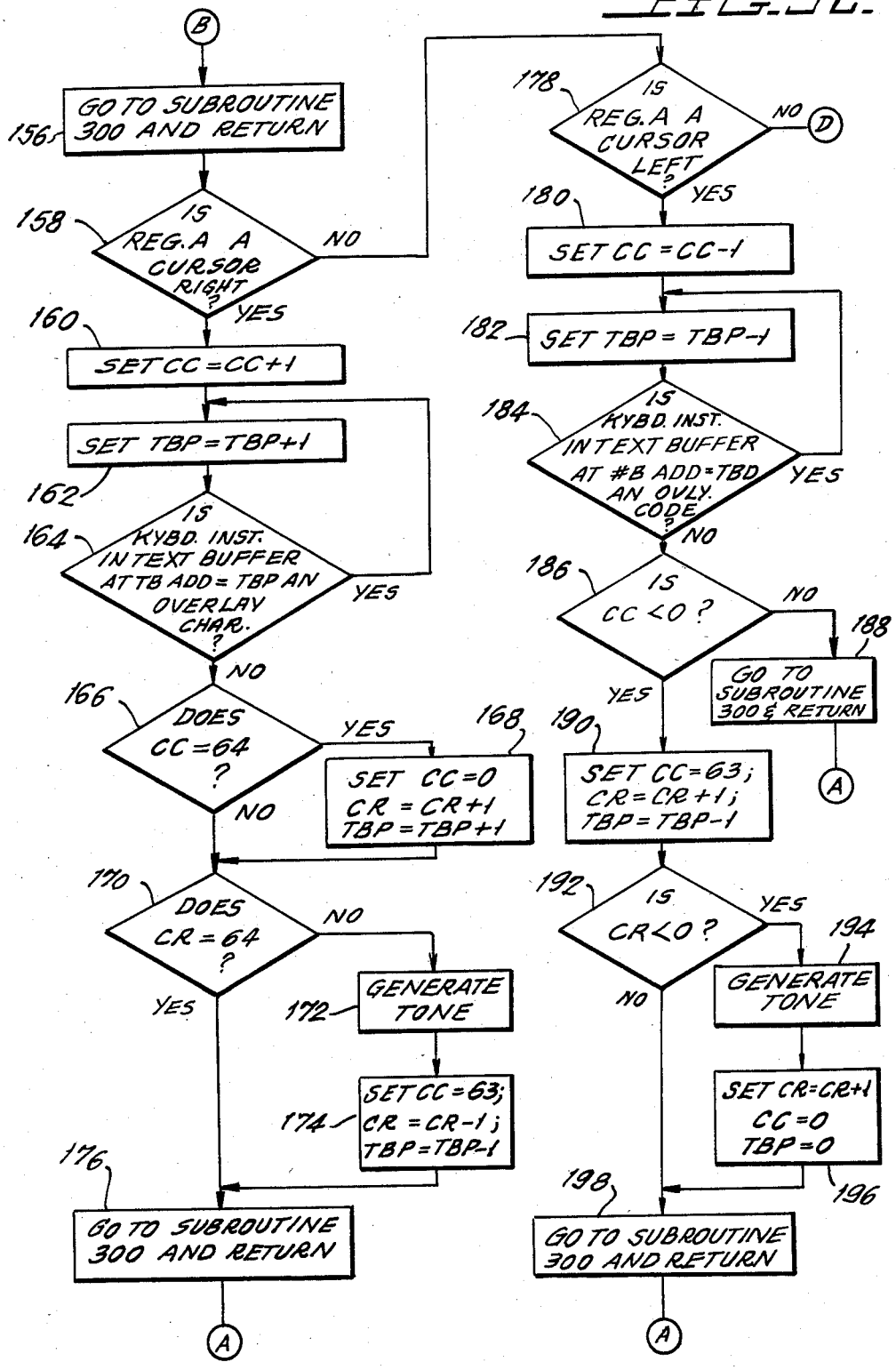

Proceeding to decision block 112, microprocessor 12 determines if the keyboard instruction in register A is a command. If it is, microprocessor 12 proceeds to instruction block 156 which is illustrated in FIG. 5C. In such a case, microprocessor 12 moves the cursor and carries out other command functions in a manner determined by the command code following the various program steps illustrated in FIGS. 5B and 5C. This action will be described below.

Returning to decision block 108, if the keyboard instruction in register A is not a command code, microprocessor 12 determines if it is an overlay code. See block 116. If it is, the character identified by the keyboard code in register A must be combined with the character in cell 46' immediately prior to the presently active cell 46'.

Figure 12:
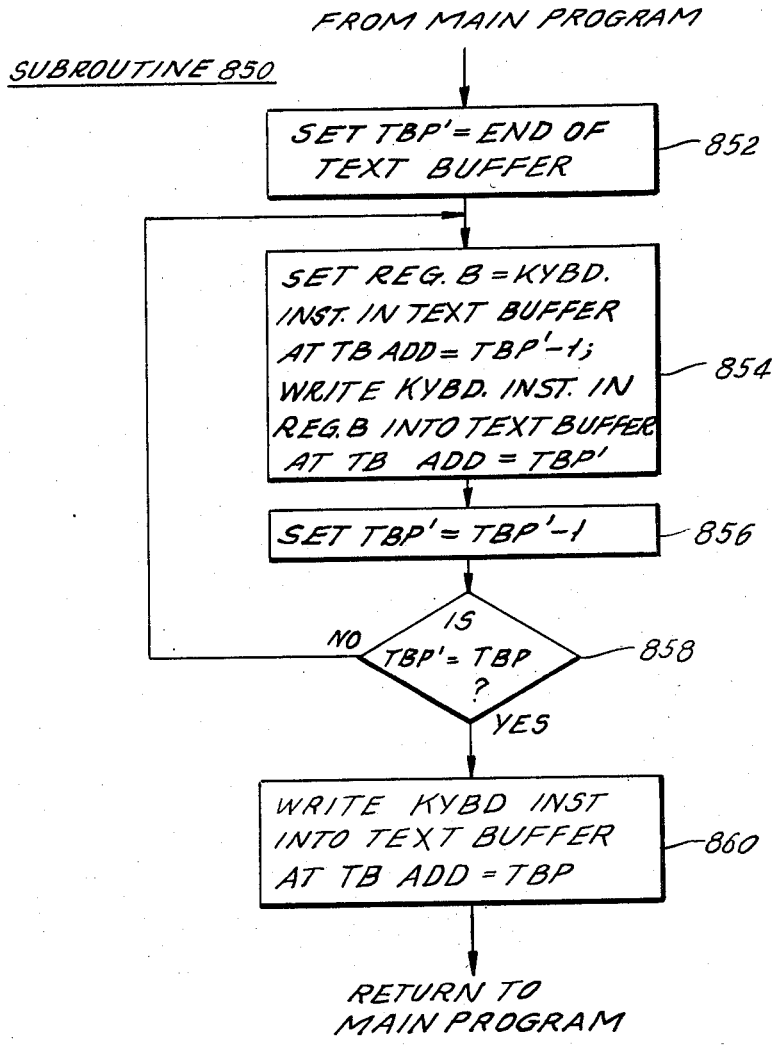

To this end, microprocessor 12 proceeds to subroutine 850 (see block 118) which is illustrated in FIG. 12. As shown therein, microprocessor 12 first sets a variable called TBP' equal to the address location of the end of the text buffer portion of RAM 28 (block 852). Proceeding to instruction block 854, microprocessor 12 sets its internal register B equal to the keyboard instruction in the text buffer at the text buffer address TBP'−1 and writes this keyboard instruction back into the text buffer at text buffer address TBP'. This has the effect of removing the keyboard instruction stored in the last address located at the text buffer RAM 28. Since the memory size of the text buffer RAM 28 will normally be substantially larger than required to store the keyboard instructions corresponding to the characters stored in display RAM 26, there normally will not be any keyboard instruction buffer at the last address location of the text buffer and no useful information will be lost. Microprocessor 12 then proceeds to instruction block 856 and sets the varible TBP' equal to TB'−1 and then determines if TBP' is equal to the actual text buffer pointer TBP (see block 858). If it is not, the program returns to block 854 and the keyboard instruction in the next to the last storage location of the text buffer RAM 28 will be moved into the last storage location of the text buffer RAM 28. This process is repeated until the variable TBP' is equal to the text buffer pointer TBP. The effect of the foregoing is to move all of the keyboard instructions in the text buffer RAM 28, which instructions are in address locations below the location of the active cell, one storage location down (towards the end of RAM 28). This permits the insertion of the keyboard instruction corresponding to the overlay character into the text buffer RAM at the text buffer address TBP. See instruction block 860. At this point, microprocessor 12 returns to the main program.

Returning to FIG. 5A, microprocessor 12 proceeds to instruction block 120 and increases the text buffer pointer TBP by one (so as to identify the next address location in the text buffer). Microprocessor 12 then proceeds to instruction block 122 which causes it to go to subroutine 700 which places the overlay character identified by the keyboard instruction in register A (the last keyboard instruction generated by the keyboard 38) into the display RAM 26 at the character cell 46 proceeding the active character cell so that the overlay character is combined with the base character already stored in that cell.

Figure 10:
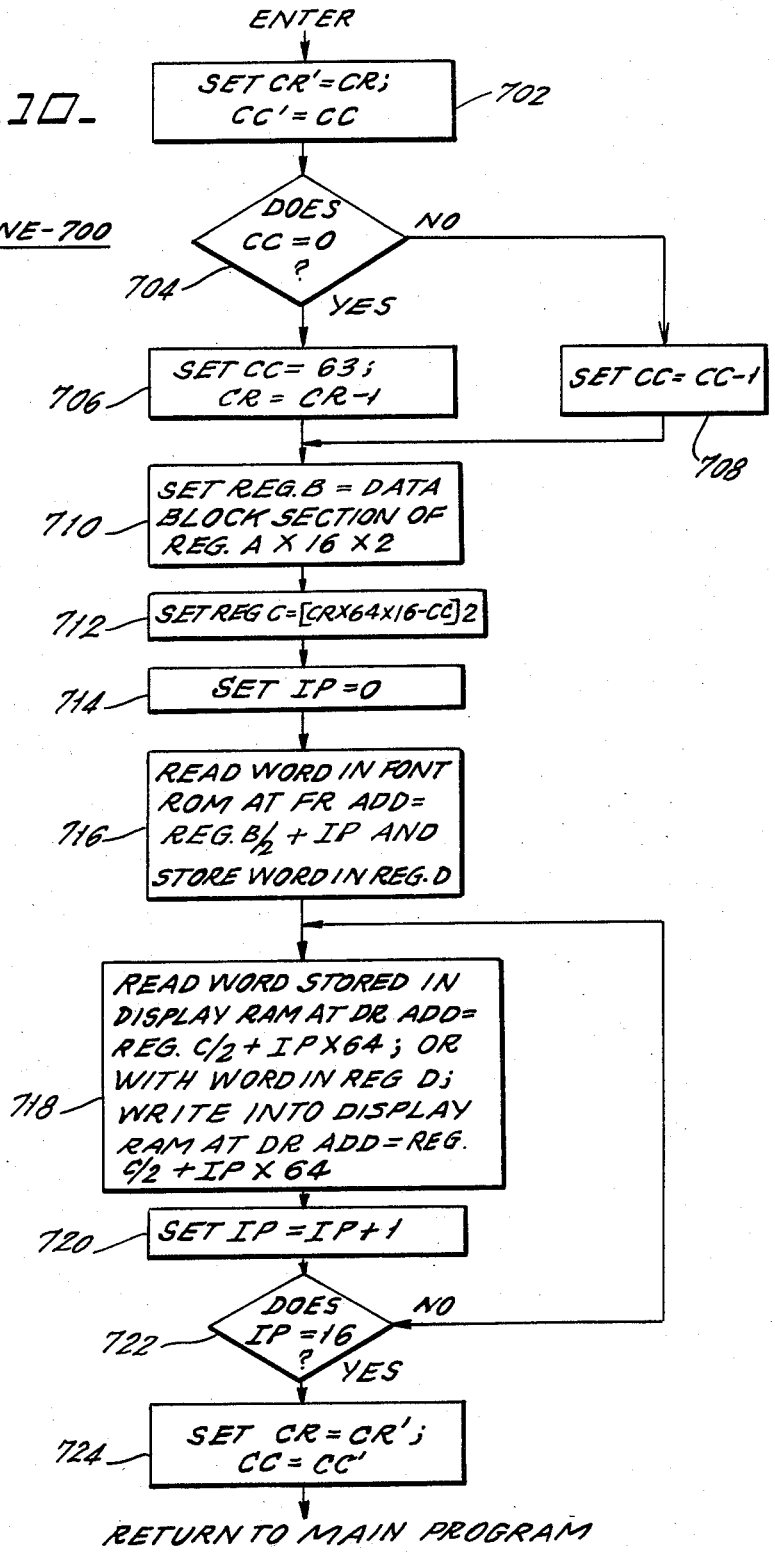

As shown in FIG. 10, microprocessor 12 carries out this process by first proceeding to instruction block 702 wherein it sets the variables CR′=CR and CC′=CC. Proceeding to decision block 704, microprocessor 12 determines if the character column is zero. If it is, the overlay character must be placed in the rightmost character cell 46 in the prior row. Thus, instruction block 706 requires microprocessor 12 to set CC=63 and CR=CR−1. If the character column does not equal zero, the overlay character must be placed in the character cell 46′ immediately to the left of the active character cell 46′. To this end, microprocessor 412 decrements the cell column pointer CC as required by instruction block 708.

Proceeding to instruction block 710, microprocessor 12 multiplies the data block section of the keyboard instruction stored in register A by 16×2 and stores this figure in its internal register B. This number identifies the address location in font ROM 24 of the first data word of the character set corresponding to the overlay character identified by the keyboard instruction stored in register A.

Proceeding to block 712, microprocessor 12 sets its internal register C equal to:

$$REG\ C=[CR\times 64\times 16+CC]2 \qquad \text{Eq. 2}$$

Since there are 64×16 address locations in each cell row of display RAM 26, equation 2 identifies the address in display RAM 26 of the first data word of the character cell 46′ into which the overlay character is to be written. The address generated by microprocessor 12 is double the actual address applied to the display RAM 26 since the least significant bit of the address generated by microprocessor 12 is not applied to address bus 14.

Microprocessor 12 now proceeds to instruction block 714 and causes microprocessor 12 to set the incremental pointer variable IP=0. This number can be stored in an appropriate storage location of text buffer and scratch pad RAM 28.

Proceeding to instruction block 716, microprocessor 12 reads the data word stored in font ROM 24 at the following font ROM address and stores the word in its internal register D:

$$FR\ ADD=REG\ B/2+IP \qquad \text{Eq. 3}$$

Since the incremental pointer IP is zero, microprocessor 12 reads the first data word of the character set which corresponds to the character identified by the keyboard instruction stored in register A from font ROM 24 into register D. Microprocessor 12 then proceeds to instruction block 718 where it effectively combines the first data word of the base character which is stored in the last active cell and the last data word of the overlay character which is being added to the cell 46′ to form the first data word of the complex character which is then written back into the cell 46′. Particularly, the data word stored in the display RAM 26 at:

$$DR\ ADD=REG\ C/2+IP\times 64 \qquad \text{Eq. 4}$$

is logically OR'ed with the data word stored in register D and OR'ed word is then written into the display RAM at the following display RAM address:

$$DR\ ADD=REG\ C/2+IP\times 64 \qquad \text{Eq. 5}$$

Proceeding to instruction block 720, microprocessor 12 increments the incremental pointer variable IP by one and determines if the incremented pointer is equal to 16. If it is not, the program returns to instruction block 718. This will cause the program to advance through instruction blocks 718 and 720 a total of 16 times in order that all 16 data words of the character cell 46′ are OR'ed with the 16 data words of the character code corresponding to the overlay character and are then rewritten into the character cell 46′. At this time, the complex character will appear in the cell 46′.

Once the incremental pointer is equal to 16, microprocessor 12 proceeds to instruction block 724 and sets the cell row and cell column pointers equal to the variables CR′ and CC′, respectively. This has the effect of identifying the character cell 46′ following the character cell 46′ in which the complex character is stored as the active character cell. At this point, the overlay routine has been completed and microprocessor 12 requests a new keyboard instruction from the keyboard 38 by returning to instruction 106.

Returning to decision block 116 (FIG. 5A), if the keyboard instruction stored in register A is neither a command code nor an overlay code, it must be a base character code. In such case, microprocessor 12 wants to place the new base character in the active character cell 46′ of the RAM display 26 and also wants to place the keyboard instruction in register A into the appropriate address location in the text buffer RAM 28. Proceeding to instruction block 124, microprocessor 12 stores the keyboard instruction in register A in the text buffer 28 at the text buffer address=TBP. In this manner, the present keyboard instruction replaces any prior keyboard instruction which had been in the text buffer at that text buffer address. Microprocessor 12 will also place the character identified by the keyboard instruction in the active character cell 46′. See instruction block 132. Since the new keyboard instruction is effectively replacing whatever character had been in the active character cell 46′ and since that character may have been a complex character, the microprocessor 12 must determine if any overlay characters are stored in successive locations in the text buffer RAM 28. To this end, microprocessor 12 proceeds to instruction block 126 and increments the text buffer pointer by one. Proceeding to decision 128, microprocessor 12 determines if the keyboard instruction stored in the text buffer RAM 28 at the address location TBP is an overlay character. If it is, this character must be removed and the remaining characters in the text buffer RAM 28 must be moved up by one address location. To this end, microprocessor 12 proceeds to instruction block 130 which causes it to go to subroutine 800 and return.

Referring to FIG. 12, microprocessor 12 will first proceed to instruction block 802 and will set the variable TBP'=TBP. Proceeding to instruction block 804, microprocessor 12 places the keyboard instruction in the text buffer at the text buffer address TBP'+1 into its internal register B and then writes that keyboard instruction back into the text buffer at the text buffer address=TBP'. Microprocessor 12 then increments the variable TBP' by one (block 806) and determines if this variable is greater than the last address location in the text buffer RAM 28 (block 808). If it is not, the program returns to instruction block 804. The result of the foregoing is that each of the keyboard instructions stored in the text buffer RAM 28 at address locations which are greater than the address location TBP will be moved up one position so that the address location of the overlay character which has been removed from the text buffer RAM 28 will be used and there will be no gaps in the text buffer. At this point, microprocessor 12 returns to the main program at decision block 128 (FIG. 5A) to determine if the keyboard instruction which has been moved into the text buffer address=TBP is also an overlay character (this will happen only when the character previously stored in the active character cell was a complex character including several overlay characters). If it is, the program will again return to instruction block 130, erase that keyboard instruction from RAM 28 and move the remaining keyboard instructions in the text buffer RAM 28 up one storage location. This process is repeated until each of the overlay characters which was previously associated with the active character cell 46' have been removed.

Once this has been completed, microprocessor 12 proceeds to instruction block 132 (FIG. 5B) and writes the character identified by the keyboard instruction stored in register A into the active cell 48' of display RAM 26 by going to subroutine 400 and returning (see block 138). Display character subroutine 400 is illustrated in FIG. 7 and causes the character identified by the keyboard instruction in register A to be placed in the active cell 46' of display RAM 26. This, in turn, causes the character to be displayed in the active character cell 46 of CRT 40.

Referring to FIG. 7, microprocessor 12 first proceeds to instruction block 402 which causes microprocessor 12 to set its internal register B with the following number:

$$REG\ B = REG\ A \times 16 \times 2 \qquad \text{Eq. 6}$$

This calculation results in a number being stored in register B which corresponds to the address location in font ROM 24 where the first data word of the character set identified by the character code identified by keyboard 38 is located. Again, it should be remembered that the multiplicand 2 is used in equation 3 to ensure that the address generated by the microprocessor 12 is twice address received by font ROM 24.

Microprocessor 12 then proceeds to instruction block 404 and sets its internal register C with the following number:

$$REG\ C = CR \times 64 \times 16 \times 2 + CC \times 2 \qquad \text{Eq. 7}$$

Equation 7 identifies the address in display RAM 26 of the first data word of the active character cell 46'. Again, the address generated by microprocessor 12 is double the actual address signal applied to display RAM 26 since the least significant bit of the address generated by microprocessor 12 is not applied to address bus 14.

Microprocessor 12 now proceeds to instruction block 406 which causes microprocessor 12 to set the incremental pointer variable IP=0. This number can be stored in an appropriate storage location of text buffer and scratch pad RAM 28. Proceeding to instruction block 408, microprocessor 12 reads the word stored in font ROM 24 at the following font ROM address and stores the word in its internal register D:

$$FR\ ADD = REG\ B/2 + IP \qquad \text{Eq. 8}$$

Since the incremental pointer IP is zero, equation 8 causes microprocessor 12 to read the first word of the character set which corresponds to the character identified by the character code generated by keyboard 38 from font ROM 24 into register D. Microprocessor 12 then proceeds to instruction block 410 and writes the word stored in register D into the display RAM 26 at the following display RAM address:

$$DR\ ADD = REG\ C/2 + IP \times 64 \qquad \text{Eq. 9}$$

Since the incremental pointer IP is set at zero, microprocessor 12 will write the data word stored in register D into the display RAM 26 at the display RAM address corresponding to the first address of the active character cell 46'. Proceeding to instruction block 412, the microprocessor 12 increases the incremental pointer by one and then proceeds to decision block 414. If the incremental pointer is less than 16, microprocessor 12 returns to instruction block 408 and reads the data word located in the next address location of font ROM 24 (since incremental point IP now is equal to 1) into register D. This data word is then read into the second storage location of the active character cell 46' and the incremental pointer is again increased by one. This process repeats itself 16 times with the result that the 16 data words of the character set corresponding to the keyboard instruction stored in register A are placed in the 16 storage locations of the active character cell 46' of display RAM 26. Simultaneously, display RAM 26 causes this character to appear in the active character cell 46 of CRT 40. Once microprocessor 12 has stepped through instruction blocks 408–412 16 times, the incremental pointer will be equal to 16 and microprocessor 12 will return to the main program.

Referring again to FIG. 5B, microprocessor 12 proceeds to instruction block 134 and increases the cell column pointer CC by one. Proceeding to instruction block 136, microprocessor 12 determines if the cell column pointer is equal to 64. If it is not, microprocessor 12 proceeds directly to decision block 148. If the cell column pointer is equal to 64, this indicates that the cursor has moved off the right-hand edge of CRT 40 and must be reset at the leftmost character cell 46' of the next cell row. To this end, microprocessor 12 proceeds to instruction block 146 wherein it sets the cell column pointer at zero and increases by the cell row pointer by one. Before proceeding to instruction block 146, microprocessor 12 must update the text buffer. To this end, microprocessor 12 proceeds to decision block 138 and determines if the keyboard instruction in the text buffer RAM 28 at the text buffer address TBP is a carriage return. If it is, microprocessor 12 proceeds directly to instruction block 144. If it is not, a carriage return keyboard instruction must be inserted into the text buffer at the text buffer address TBP and the remaining keyboard instructions stored in the text buffer below that address must be moved down by one. To this end, microprocessor 12 first stores the keyboard instruction for a carriage return in its internal register A (see block 140) and then proceeds to subroutine 850 which has been described above. See block 142. When the insertion of the keyboard instruction into the text buffer RAM 28 has been completed, microprocessor 12 proceeds to instruction block 144 where it increases the text buffer pointer TBP by one. Microprocessor 12 then sets the cursor column pointer at zero and increases the cursor row pointer by one in order to place the active cell in the left-hand corner of the next succeeding row.

Microprocessor 12 then proceeds to decision block 148 and determines if the cell row is equal to 64. If it is, this indicates that an attempt has been made to drop the cursor below the bottom edge of CRT 40. Since this is an invalid condition, microprocessor 12 causes the generation of a tone (this may be done in any known manner) which alerts the user of system 10 to the invalid condition (see block 150). Microprocessor 12 then proceeds to instructon block 152 which resets the cursor row and cursor column pointers at 63 and writes a cursor 48 in the last character cell 46' in the display RAM 38. The program then returns to decision block 106 wherein the microprocessor waits for another keyboard instruction to be generated by keyboard 38.

Returning to decision block 148, if the cell row is less than 64, microprocessor 12 proceeds directly to instruction block 154 which directs it to go to subroutine 300 and return. As a result, a cursor 48 will appear at the bottom of the active character cell 46 identified by the cursor row and cursor column pointers. At this point, microprocessor 12 returns to decision block 106 and waits for an additional keyboard instruction to be generated by keyboard 38.

The manner in which microprocessor 12 responds to a command code keyboard instruction generated by keyboard 38 will now be described with reference to FIGS. 5C–5E. After microprocessor 12 has determined that the keyboard instruction generated by keyboard 38 is a command code (see decision block 114 of FIG. 5), it proceeds to instruction block 156 (FIG. 5C) which causes it to go to cursor subroutine 300 and return. This causes the cursor 48 previously placed in the active character cell 46 identified by the cell row and cell column pointers to be removed.

Proceeding to decision block 158, microprocessor 12 determines if the keyboard instruction is a cursor right command code. If it is, microprocessor 12 proceeds to instruction block 160 and increases the cell column pointer by one. Microprocessor 12 then proceeds to instruction block 162 and increases the text buffer pointer TBP by one. Proceeding to decision block 164, microprocessor 12 determines if the keyboard instruction in the text buffer RAM 28 at the text buffer address TBP is an overlay character. If it is, the program returns to instruction block 162 so as to again increment the text buffer pointer TBP. This process will be continued until the text buffer TBP is associated with a keyboard instruction which is not an overlay character. This effectively advances the text buffer pointer to the first keyboard instruction associated with the active cell defined by cursor row and column pointers CR, CC. At this point, microprocessor 12 proceeds to decision block 166 and determines if the cell column pointer is equal to 64. If it does equal 64, the cursor 48 cannot be moved further to the right in the present cell row. Rather, it must be moved to the leftmost character cell 46 of the following cell row. To this end, microprocessor 12 sets the cell column pointer at zero, increases the cell row pointer by one and increases the text buffer pointer TBP by one as shown in instruction block 168. If the cell column pointer is less than 64, or if it was equal to 64 and has been reset in accordance with instruction block 168, microprocessor 12 proceeds to decision block 170 and determines if the cell row pointer is equal to 64. If it is, this indicates that an attempt has been made to move the cursor 48 off of the bottom right-hand corner of CRT 40. Since this is an invalid condition, microprocessor 12 causes the generation of a tone (see instruction block 172), sets the cell column pointer at 63, reduces the cell row pointer by one and decreases the text buffer pointer TBP by one (see instruction block 174). This has the effect of moving the cursor 48 to the last cell column in the last cell row of CRT 40 once microprocessor 12 advances to instruction block 144. If the cell row pointer does not equal 64 (see decision block 170), or if it did equal 64 and had been reset in block 174, microprocessor 12 proceeds to instruction block 176 and places a cursor 48 on the bottom of the active character cell 46.

Returning to decision block 158, if microprocessor 12 determines that the keyboard instruction in register A is not a cursor right command, it proceeds to decision block 178 and determines if iy is a cursor left command. If it is, it proceeds to instruction block 180 and reduces the cell column pointer by one. Since the active cell has been moved to the right by one cell column, the text buffer pointer TBP must also be advanced to the address location of the first keyboard instruction associated with the new active character cell 46'. To this end, microprocessor 12 proceeds to instruction block 182 and increases the text buffer pointer by one. Microprocessor 12 then determines if the keyboard instruction in the text buffer RAM 28 at the text buffer address TBP is an overlay character. If it is, the text buffer pointer must be again incremented. The text buffer pointer will continue to be incremented until the keyboard instruction with which it is associated is not an overlay character.

At that point, microprocessor 12 proceeds to decision block 186 and determines if the cell column pointer is less than zero (see decision block 186). If it is not, microprocessor 12 proceeds to instruction block 188 which causes a cursor 48 to be placed in the bottom of the active character cell 46 defined by the modified cell column pointer. At this point, the program returns to decision block 106 and the microprocessor 12 waits for the next keyboard instruction in register A generated by keyboard 38.

Returning to decision block 180, if the cell column pointer is less than zero, this indicates that an attempt has been made to move the cursor 48 off the left-hand side of the CRT 40. Accordingly, the cursor 48 must be moved up one cell row and must be moved to the rightmost column. The text buffer pointer TBP must also be adjusted to point to the keyboard instruction associated with the newly active cell 46. To this end, microprocessor 12 resets the cell column pointer at 63, decreases the cell row pointer by one and decreases the text buffer pointer by one (see instruction block 190). Proceeding to decision block 192, microprocessor 12 determines if the cell row pointer is less than zero. If it is, this indicates that an attempt has been made to move the cursor to a point above the top cell row of the CRT 40. Since this is an invalid condition, microprocessor 12 generates a tone (see instruction block 158), resets the cell column pointer to zero, increases the cell row pointer by one and sets the text buffer pointer to zero. This has the effect of placing the cursor at the bottom of the upper left-hand character cell 46 of CRT 40 once the program proceeds to instruction block 198. At this point, the program will return to decision block 106 and microprocessor 12 waits for the next keyboard instruction to be generated by keyboard 38.

Returning to decision block 196, if the cell row pointer is not less than zero, microprocessor 12 proceeds directly to instruction block 198 and places a cursor 48 at the bottom of the character cell 64 identified by the cell column and cell row pointers. Thereafter, the program returns to decision block 106 and microprocessor 12 awaits the next keyboardd instruction generated by keyboard 38.

Figure 5D:
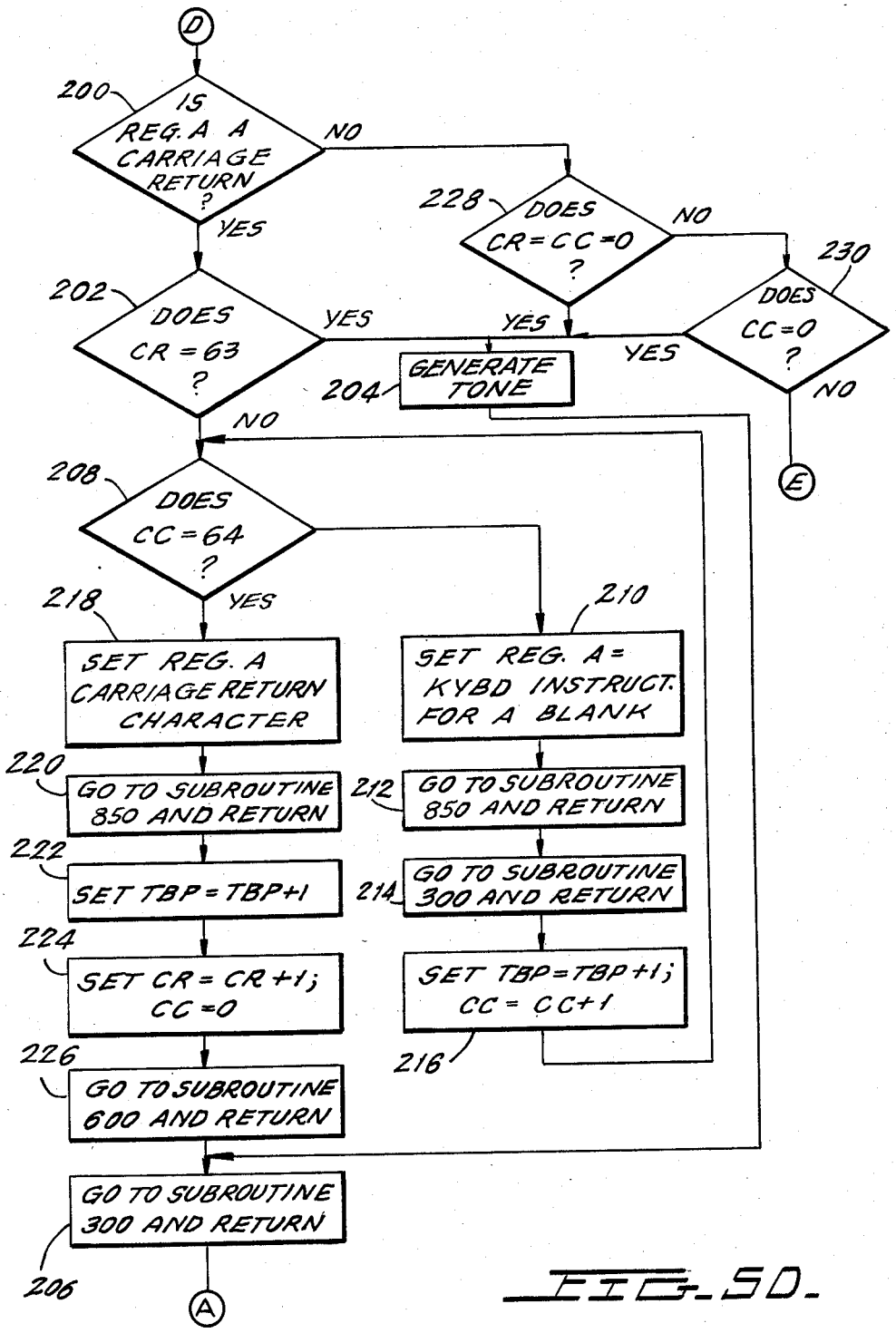
Figure 5E:
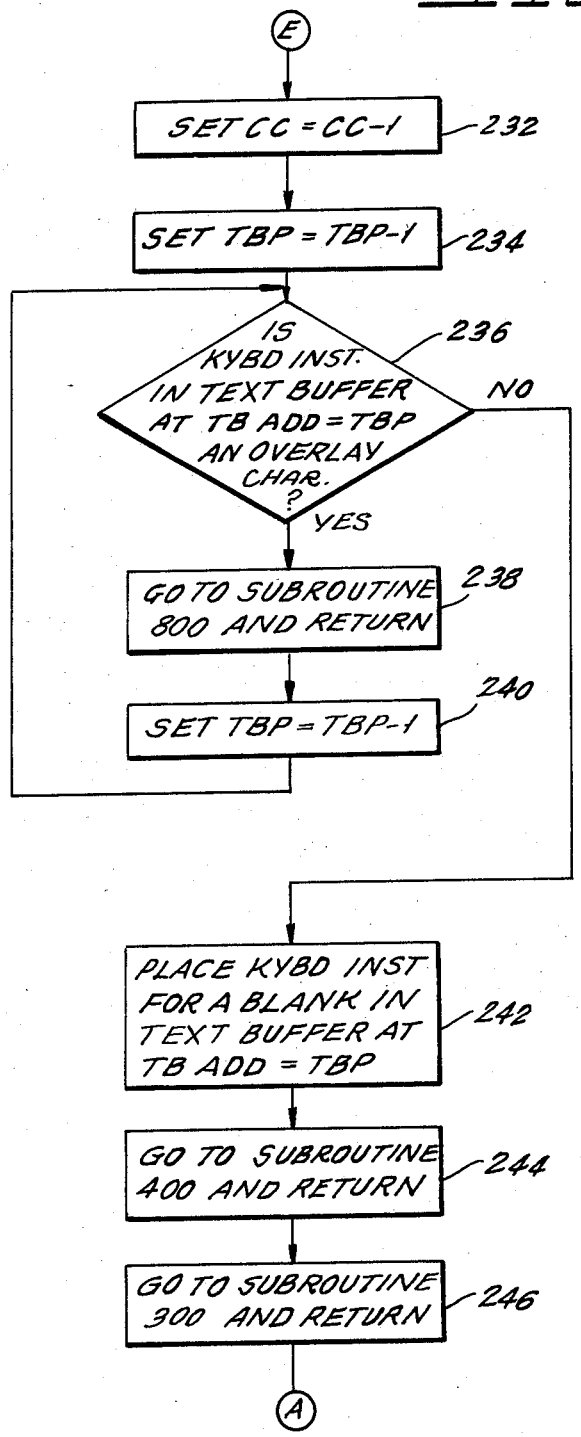

Returning to decision block 178, if microprocessor 12 determined, that the keyboard instruction stored in register B is not a cursor left command signal, it proceeds to decision block 200 (see FIG. 5D). In accordance with decision block 200, microprocessor 12 determines if the keyboard instruction is a carriage return command code. If it is, microprocessor 12 proceeds to decision block 202 and determines if the cell row pointer is equal to 63. If the cell row pointer is equal to 63, the carriage return command code is attempting to place the cursor 48 below the bottom edge of CRT 40. Since this is an invalid condition, microprocessor 12 causes the generation of a tone (see block 204) to alert the user of the invalid condition. Since the cursor 48 had been removed in instruction block 156, it must now be replaced. To this end, instruction block 206 requires that microprocessor 12 go to cursor subroutine 300 and return. Microprocessor 12 then returns to decision block 106 where it awaits the next keyboard instruction generated by keyboard 38.

Returning to decision block 202, if the cell row pointer is less than 63, microprocessor 12 proceeds to decision block 208 where it determines if the cell column pointer is equal to 64. Initially, the cell column pointer CC cannot be 64 and the program automatically proceeds to instruction block 210. In accordance with block 210, microprocessor 12 sets the keyboard instruction for a blank into its internal register A. Proceeding to instruction block 212, microprocessor 12 proceeds to subroutine 850 which inserts the keyboard instruction for a blank into the text buffer RAM 428 at the storage location corresponding to the active cell and moves all of the remaining keyboard instructions stored in the text buffer one address down. The operation of subroutine 850 has been described above and will not be repeated.

Having inserted a keyboard instruction corresponding to a blank into the appropriate location in the text buffer RAM 28, microprocessor 12 must now insert a blank into the display RAM 26 at the cell 46' which was active when the carriage return key was struck. To this end, microprocessor 12 goes to subroutine 300 and places a blank in the active character cell 46'. Having cleared the active character, microprocessor 12 proceeds to instruction block 216 and increments both the text buffer pointer and the cell column pointer by one. Microprocessor 12 then returns to decision block 208. Microprocessor 12 will continue to loop through instruction blocks 210–216 (storing keyboard instructions for a blank in the text buffer RAM 26 and storing the character set for a blank in each succeeding cell 46' in display RAM 26) until the entire row is cleared. At that point, the cell column pointer will equal 64 and microprocessor 12 proceeds to instruction block 218.

At this point, microprocessor 12 wants to set a carriage return character into the memory location in text buffer RAM 28 corresponding to the active cell at the time the carriage return was depressed and to place keyboard instructions in the address locations of text buffer RAM 28 corresponding to the remaining cells 46' of the row of the last active cell 48'. To this end, microprocessor 12 proceeds to instruction block 218 and sets the carriage return character in its internal register A. Proceeding to instruction block 220, microprocessor 12 goes to subroutine 850 and inserts the carriage return character into the text buffer RAM 28 in the manner described above. Thereafter, microprocessor 12 increases the text buffer pointer by one (instruction block 222), increases the cell row pointer by one and sets the cell column pointer at zero (instruction block 224). This effectively defines the first character cell in the next succeeding row as the active character. Microprocessor 12 then proceeds to instruction block 226 which advances to program two subroutines 600.

Figure 9:
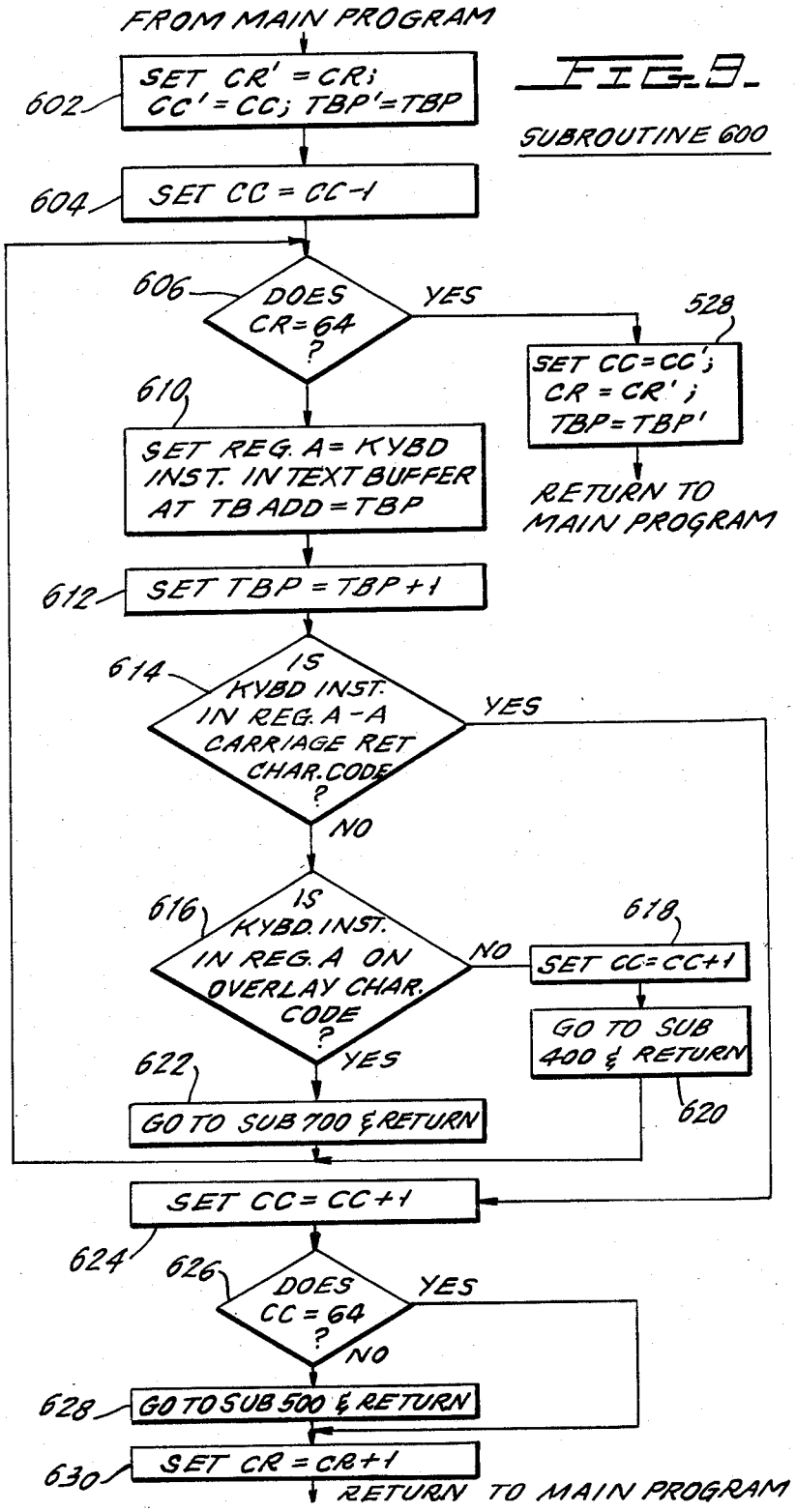

Subroutine 600 is illustrated in FIG. 9 and builds a new screen starting with the row of the newly defined active character down to the bottom of the CRT display 40.

Referring to FIG. 9, microprocessor 10 first proceeds to instruction block 602 and sets the variables CR', CC' and TBP', as shown. As the program is stepping through each successive keyboard instruction stored in the text buffer RAM 28, it will ultimately reach a carriage return code indicating that the remaining cells in that row have blanks in them. In accordance with decision block 614, the program will then proceed to instruction block 624 where it will increment the cell column pointer by one. Proceeding to decision block 626, microprocessor 12 first asks if the cell column pointer is 64. It it is, this means that there are no blank spaces to the right of the carriage return and microprocessor 12 jumps to instruction block 630 where it increases the cell row pointer by one and returns to the main program. Returning to decision block 626, if the cell column pointer did not equal 64, this indicates that blanks must be stored in the remaining cells in the active row. To this end, microprocessor 12 proceeds to instruction block 628 where it goes to subroutine 500 and returns.

Figure 8:
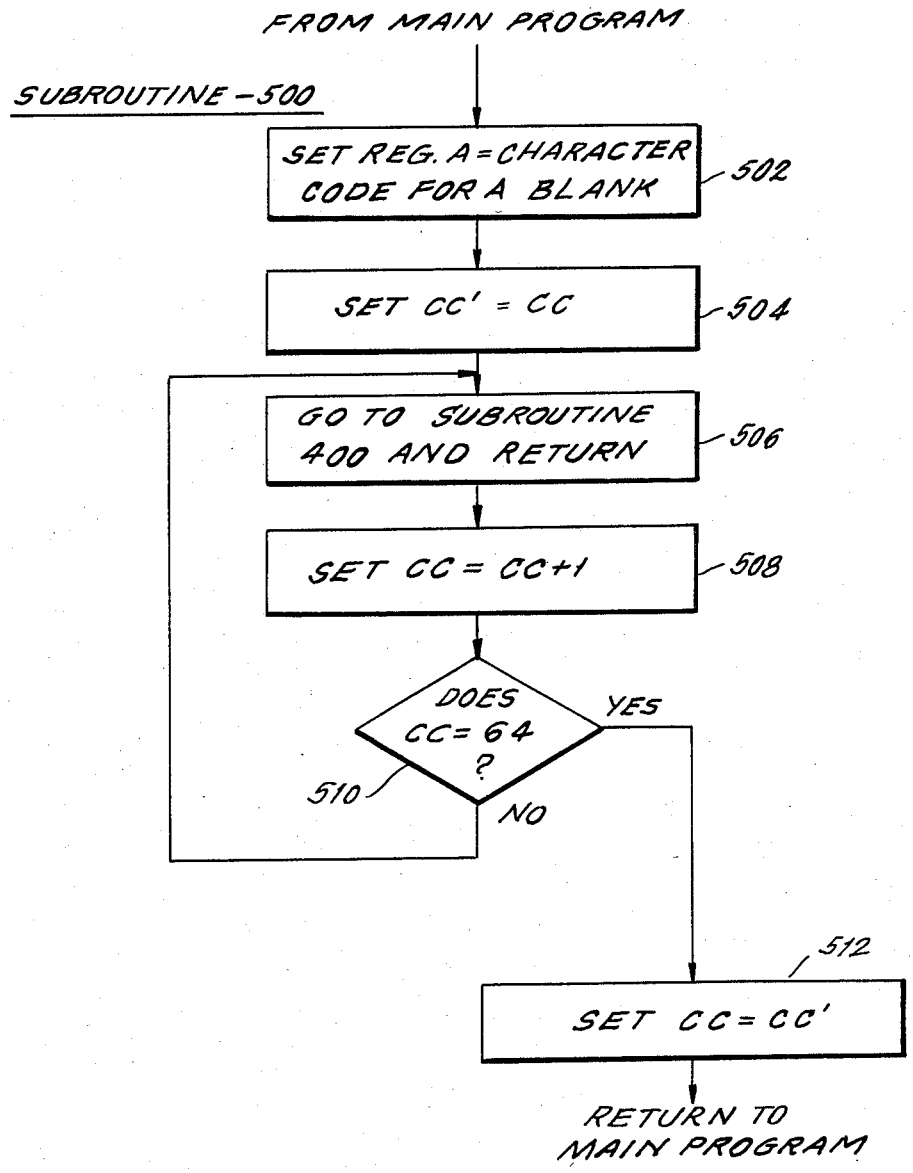

Referring to FIG. 8, microprocessor 12 first proceeds to instruction block 502 where it sets register A equal to the character code for a blank. Proceeding to instruction block 504, microprocessor 12 sets the variable CC' equal to the cell column pointer. Microprocessor 12 then proceeds to instruction block 506 which causes it to go to subroutine 400 and return with the result that the blank is placed in the active character cell. Proceeding to instruction block 508, microprocessor 12 increments the cell column pointer by one. If the cell column pointer does not equal 64 (see decision block 10), the program returns to instruction block 506 and writes the blank space into the next character cell 46'. This process continues until blank characters have been written into each of the character cells 46' of the active row. At that point, the cell column pointer will be equal to 64 and microprocessor 12 proceeds to instruction block 512 wherein it resets the cell column pointer to its original value and returns to the main program. Returning to FIG. 9, microprocessor 12 proceeds to instruction block 526 where it increases the column row pointer by one and returns to the main program (FIG. 5D). At this point, microprocessor 12 proceeds to instruction block 206 which causes it to go to subroutine 300 and return. As a result, a cursor 48 will be placed in the leftmost character cell 46 of the next charac-34 row. The program will then return to instruction block 106 and the microprocessor 12 awaits the next keyboard instruction from the keyboard 38.

Returning to decision block 200, if microprocessor 12 determines that the keyboard instruction is not a carriage return command code (it has already determined that it is not a cursor left or a cursor right command code), it must be a backspace command code since there are only four commands in the system disclosed herein. Since the keyboard instruction is a backspace command, microprocessor 12 wants to erase the character contained in the character cell immediately proceeding the active character cell and wants to remove the keyboard instruction corresponding to the erased cell from the text buffer RAM 28. To this end, microprocessor 12 first proceeds to decision block 228, and determines if the cell row and cell column pointers are both equal to zero. If they are, the backspace command is an invalid command. In such a case, microprocessor 12 generates a tone (see instruction block 204) and causes a cursor 48 to be placed in the bottom of the character cell 46 located in the upper left-hand corner of CRT 40 (see instruction block 206). The program then returns to decision block 106 and the microprocessor again awaits the next keyboard instruction generated by keyboard 38.

Figure 11:
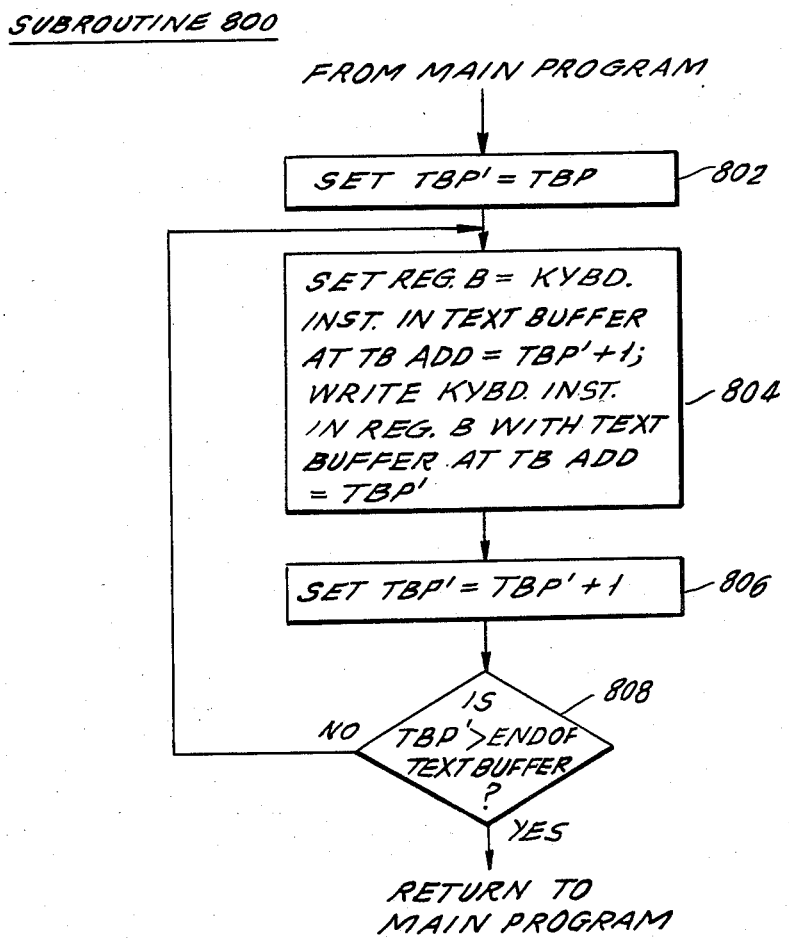

Returning to decision block 228, if the cell row and cell character pointers are not both equal to zero, microprocessor 12 proceeds to decision block 230 and determines if the cell column pointer is equal to zero. If it is not, microprocessor 12 reduces the cell column and text buffer pointers by one (see instruction blocks 232 and 234) and proceeds to decision block 23 wherein it determines if the keyboard instruction in the text buffer RAM 28 at the address TPB is an overlay character. If it is, each of the keyboard instructions associated with the newly active character cell 46' must be removed from the text buffer. To this end, microprocessor 12 proceeds to subroutine 800 (see instruction block 238) which is illustrated in FIG. 11 and has been described above. This will delete a single keyboard instruction in the text buffer and move the remaining keyboard instructions up one address location. Microprocessor 12 then proceeds to instruction block 240 where it decreases the text buffer pointer by one and returns to instruction block 236. In this manner, microprocessor 12 will remove all of the keyboard instructions associated with the active character cell. Once all of the characters associated with that cell have been removed from the text buffer RAM, the character which was previously located in the active character cell must be replaced by a blank. To this end, microprocessor 12 proceeds to instruction block 242 wherein it places the keyboard instruction for a blank in the text buffer at the text buffer address TBP and then proceeds to subroutine 400 (see block 244) wherein it writes the blank into the active character cell. Finally, microprocessor 12 proceeds to instruction block 246 which causes it to go to subroutine 300 and return. As a result, a cursor 48 will be placed at the bottom of the active character cell. At this point, the program returns to instruction block 106 wherein the microprocessor 12 awaits the next keyboard instruction from the keyboard 38.

ELECTRONIC KEYBOARD

The structure of electronic keyboard 38 is illustrated in FIG. 13. As with the main system 10, the heart of keyboard 38 is a microprocessor 38-1. Microprocessor 38-1 is preferably an 8088 microprocessor which is identical in operation to the 8086 microprocessor described above with the exception that the 8088 microprocessor transmits information from its internal memories and reads information into its internal memories only eight bits of data at a time while the 8086 microprocessor is able to read and transmit 16 bits of data. The eight bits of data which can be handled by the 8088 microprocessor are sufficient for the keyboard 38 since none of the peripheral elements of keyboard 38 require more than eight bits of data at a time. It should be recognized, however, that the 8086 microprocessor, or any other suitable microprocessor, could be used as the keyboard microprocessor.

Microprocessor 38-1 communicates with the remaining elements of keyboard 38 by writing address information onto address bus 38-2 and by both writing information onto and reading information off of data bus 38-3. Microprocessor 38-1 has a common set of input/output ports A0–A19 which are connected to both address bus 38-2 and data bus 38-3 through address latch 38-4 and transceiver 38-5, respectively. Whenever microprocessor 38-1 wishes to place address information on address bus 38-2, it generates a binary signal corresponding to the desired address on its output ports A0–A19 and generates the address latch enable signal ALE which is applied to the strobe input STB of address latch 38-4. This causes the 19 bit address signal generated by microprocessor 38-1 to be placed on the address bus 38-2. Since the output enable input $\overline{OE}$ of address latch 38-4 is grounded, the 19 bit address applied to the input of address latch 38-4 will remain on address bus 38-2 until a new address is strobed into latch 38-4. In the embodiment of keyboard 38 illustrated in FIG. 13, address lines A0–A7 are used to address program ROM 39-6 and scratch pad RAM 38-7, while address lnes A0–A1 are used to control the operation of peripheral interface 38-8. Address lines A17–A19 are applied to the inputs A0–A2, respectively, of decoder 38-9. The remaining address lines A8–A16 are not used in the present embodiment. As such, these lines need not be connected to address latch 38-4.

The address lines A17–A19 applied to decoder 38-9 cause decoder 38-9 to generate chip enable signals $\overline{E1}$–$\overline{E5}$ which selectively varies chips of keyboard 38. One suitable decoder is manufactured by Intel Corporation under the product designation 8205 one of eight decoder. The operation of this decoder has already been described above and will not be repeated at this time.

Once the appropriate address has been placed on address bus 38-2, microprocessor 38-1 can either write data onto data bus 416 or read data on the data bus 38-3 into its internal memories. This is accomplished with the use of a transceiver 38-5 which may be an 8286 Octal Bus Transceiver manufactured by Intel Corporation.

In the keyboard 38 described herein, all data information is transmitted as either an 8 bit or a 3 bit word. For this reason, only output lines A0–A7 are applied to transceiver 38-5. Transceiver 38-5 applies the eight bits of data contained on the output ports A0–A7 of microprocessor 38-1 onto data bus 38-3 whenever the data enable signal $\overline{DEN}$ is applied to its output enable input $\overline{OE}$ signal and the data transmission signal DT/$\overline{R}$ is at the binary "1" level. When the data enable signal $\overline{DEN}$ is generated but the data transmit signal DT/$\overline{R}$ is at the binary "0" level, data contained on the bus 38-3 will be applied to ports A0–A7 of microprocessor 38-1 and will be thereby read into the internal memories of the microprocessor 38-1.

Figure 15A:
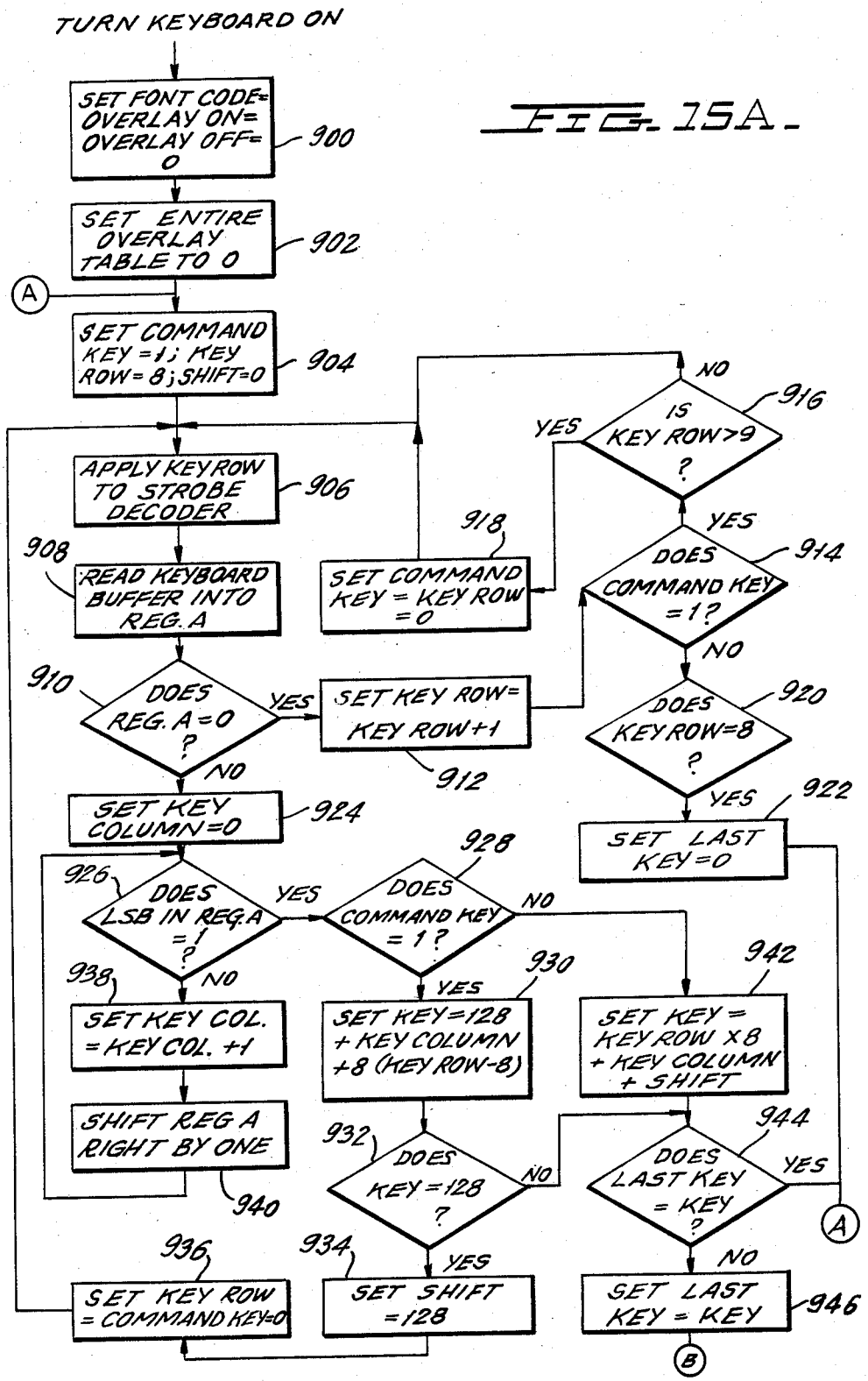
FIGS. 15A, 15B and 15C are flow diagrams illustrating the keyboard program stored in the program RAM of FIG. 13.
Figure 15B:
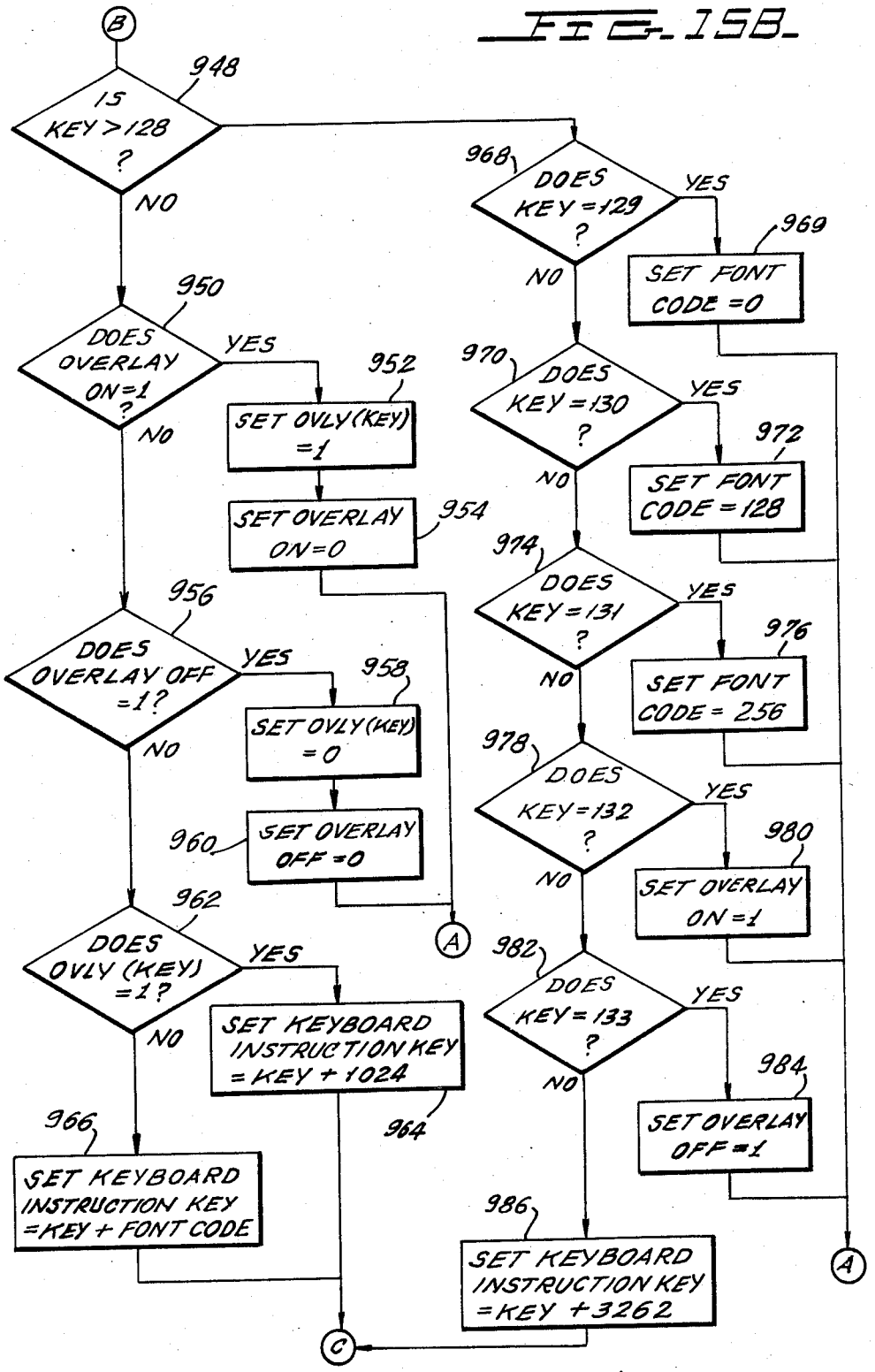
Figure 15C:
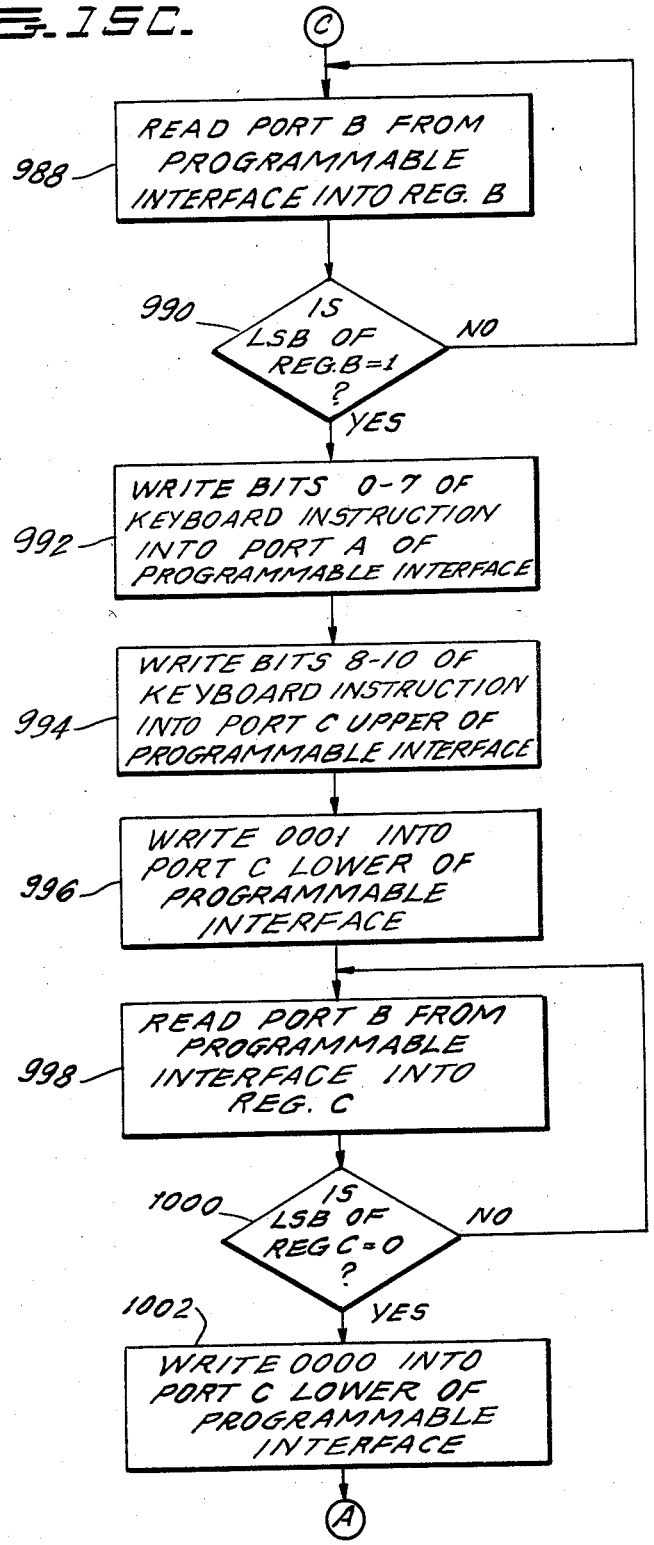

Microprocessor 38-1 controls the operation of keyboard 38 by following a software program stored in program ROM 38-6. The software program, which will be described below with reference to the flow diagrams of FIGS. 15A–15C, is stored in the program ROM 422 in machine code as a plurality of 8 bit words. Microprocessor 412 sequences through the various steps of its program by periodically requesting new program instructions from program ROM 38-6 at time intervals determined by clock pulses generated by keyboard clock 38-11. Each time microprocessor 38-1 needs a new program instruction, it applies that address signal to address bus 38-2 and generates the read signal $\overline{RD}$. As a result, an 8 bit word containing the desired program instruction is placed on data bus 38-3. Microprocessor 38-1 then reads this instruction into its internal memory via transceiver 38-5. While any available memory can be used, one suitable program ROM 38-6 is an 8K×8 UV erasable (PROM) sold by Intel Corporation under product designation 2764.

Following the program instructions contained in program ROM 3806, microprocessor 38-1 causes keyboard 38 to generate an 11 bit keyboard instruction which comprises a 2 bit format block followed by a 9 bit data block. As noted above, keyboard 38 can generate three type of keyboard instructions: base character codes, overlay character codes and command codes. The format block identifies which type of code the keyboard instruction contains. In the embodiment disclosed, the presence of bits 00 in the format block identify the keyboard instruction as a base character code, the presence of bits 01 in the format block identify the keyboard instruction as an overlay character code, and the presence of bits 11 in the format block identify the keyboard instruction as a command code.

The program stored in program ROM 38-6 causes microprocessor 38-1 to repeatedly scan keyboard switch assembly 38-10 and to determine what character or command keys have been depressed by the user of system 10 and to generate appropriate keyboard instructions as a function thereof.

The structure of keyboard switch assembly 38-10 is illustrated in FIG. 9. Keyboard switch assembly 38-10 comprises a switch matrix 38-12, a strobe decoder 38-14, a keyboard buffer 38-16 and a latch 38-18. In the embodiment illustrated, switch matrix 38-12 is an 8×10 matrix having eight columns 0–7 and 10 rows 0–9. A respective normally open switch SW0–SW79 is connected at the crossover point of each column and each row. Thus, switch SW0 is connected between row 0 and column 0, switch SW1 is connected between row 0 and column 1, etc. Each switch SW0–SW79 is associated with a respective physical key (not shown) of the physical keyboard which is normally biased into an upper position and which may be moved into a lower position by the user of system 10 by depressing the key. Each switch SW0–SW79 is preferably a Hall effect or other non-bounce switch to ensure that a single signal is generated for each depression of its associated physical key.

Switch matrix 38-12 is logically broken into two submatrices: command matrix 38-20 and character matrix 38-22. Each switch SW0–SW63 of the character matrix 38-20 is associated with a respective character key on the physical keyboard. The physical keyboard can take any form desired and is preferably a modified QWERTY keyboard enabling the entry of alphanumeric characters, punctuation characters, a blank space, diacritics, and any additional special characters desired up to a total of 128 characters. These 128 characters correspond to the 128 character codes representing each font stored in font ROM 24. While the physical location of each of the keys of the physical keyboard can be arranged in any order desired, it is preferable that the electrical connection of the various switches SW0–SW63 associated with the physical keys of the physical keyboard have a one-to-one correspondence with the 128 character codes of the characters stored in font ROM 22. (In this connection, each character key of the physical keyboard is associated with two characters as a function of the position of the shift key so that the 64 character keys are associated with 128 character codes. This relationship is described in further detail below.) In the example set forth above, the character "a" of the font ROMAN 1 is accorded the character code "0", the character "b" of the font ROMAN 1 is accorded the character "1", etc. For this reason, it is preferred that the physical key corresponding to the character "a" be connected to normally open switch SW0, the physical key corresponding to the character "b" be connected to normally open switch SW1, etc. This relationship is referred since it simplifies the programming of both the system microprocessor 10 and the keyboard microprocessor 12.

The command matrix 38-22 includes two rows of normally open switches SW64–SW79 which correspond to the 16 control keys on the physical keyboard. The control keys will include the backspace key, the carriage return key, the three font keys identifying the fonts ROMAN 1, ROMAN 2 and HEBREW, the cursor left and cursor right keys, the shift key, overlay on and overlay off keys (the function of these keys will be described below) and any other control functions which may be required for the system.

In the embodiment disclosed, the command matrix switches will be assumed to be associated with the following command keys of the physical keyboard in accordance with the following table:

TABLE 1

| Switch No. | Command Key |
|---|---|
| SW64 | SHIFT |
| SW65 | ROMAN 1 |
| SW66 | ROMAN 2 |
| SW67 | HEBREW |
| SW68 | OVERLAY ON |
| SW69 | OVERLAY OFF |
| SW70 | CURSOR LEFT |
| SW71 | CURSOR RIGHT |
| SW72 | CARRIAGE RETURN |
| SW73 | BACKSPACE |

In accordance with the foregoing, switches SW74–SW79 are not used in the present system. If desired, these switches may be used to generate additional command signals such as cursor up, cursor down, etc., as well as to identify additional fonts if more than three font styles are stored in font ROM 22. Additional switches to accommodate additional command keys may also be employed as needed.

Micoprocessor 38-1 responds to the closure of each of the command switches SW64–SW73 by generating a unique key number in response thereto. Particularly, microprocessor 38-1 generates KEY numbers 128–137 in response to the closure of command matrix switches SW64–SW73, respectively. These KEY numbers are used by the software of microprocessor 38-1 to determine which command functions should be carried out and what KEYBOARD instructions should be generated by keyboard 38.

While each switch SW64–SW79 (and, therefore, each command key) of the command matrix 38-20 is associated with a single KEY number, each switch SW0–SW63 of the character matrix 38-22 is associated with a pair of key numbers. Effectively, the character matrix 38-22 operates in two planes: an upper case plane and a lower case plane. Matrix 38-22 operates in the lower case plane whenever the shift command key is not depressed. Each physical key of the character keyboard will be associated with a unique character in this plane, i.e., the lower case alphabetical characters, numerical characters, most punctuation marks, etc. When the matrix 38-22 is operated in the lower case plane, microprocessor 38-1 generates a unique KEY number in response to the depression of a given character key. For example, when the character key "a" is depressed (this key is connected to switch SW0), and the matrix 38-22 is being operated in the lower case plane, microprocessor 38-1 generates the KEY number 0 identifying the lower case "a".

Each physical key of the character keyboard will also be associated with a unique character in the upper case plane, i.e., the upper case alphabetical characters, exclamation characters, diacritis, etc. When matrix 38-22 is operated in the upper case plane (when the shift key is depressed), microprocessor 38-1 generates a unique key number in response to the depression of a given character key. For example, when the character key "a" is depressed and matrix 38-22 is being operated in the upper case plane, microprocessor 412 generatees the KEY number 63 identifying the upper case "A".

In the following discussion, any character associated with the upper case plane of the matrix 462 will be referred to as an upper case character while any character associated with the lower case plane will be referred to as a lower case character. Each character key of the physical keyboard will have an associated upper and lower case character. The upper case character is accessed by depressing both the shift key and the character key. The lower case character is accessed by depressing the character key alone. In the following discussion, any reference to depressing the key associated with a given character shall inherently include the step of depressing the shift key when the character in question is an upper case character.

To determine which keys have been depressed by the user, microprocessor 38-1 periodically scans keyboard matrix 38-12. From the standpoint of microprocessor 412, the command matrix 38-20 and the character matrix 38-20 represent separate keyboards: one generating command information, one generating character information. Microprocessor 38-1 scans these keyboards separately to determine the character and command information being entered by the user. In the embodiment disclosed, microprocessor 38-1 first scans command matrix 38-20 to determine if any command keys have been depressed by the user and then scans character matrix 38-22 to determine if any character keys have been depressed.

Under normal operating conditions, only one key of the command matrix 38-20 or one key of the character matrix 38-22 will be depressed at any given instant. The one exception to this rule concerns the shift key which determines which plane (upper or lower case) the character matrix 38-22 is operating in. Under normal conditions, both the shift key and a character key will be depressed at the same time.

To determine which command key has been depressed, microprocessor 38-1 sequentially scans each row 8, 9 of command matrix 38-20. To scan row 8, microprocessor 38-1 places the address 1001 (decimal 9) on data lines D0–D3 of data bus 38-3 and causes decoder 38-9 to generate the chip enable signal $\overline{E2}$. This causes latch 38-18 (which may be an 8282 Octal Latch) to latch the four bits on lines D0–D3 of data bus 38-3 and apply them to the inputs A0–A3 of strobe decoder 38-14. As a result, the output $\overline{08}$ of decoder 38-14 will be set and the remaining outputs will be reset. Since each of the columns 0–7 of keyboard matrix 38-12 are biased high by an appropriate voltage +V, this effectively disables all but row 8 of keyboard matrix 38-12.

As a result of the foregoing, an 8 bit binary number indicative of the condition of switches SW64–SW71 of row 8 of matrix 38-20 is applied to the inputs DI0–DI7 of keyboard buffer 38-16. Particularly, any switch SW64–SW71 which is closed will apply a binary "0" to the respective data input DI0–DI7 of keyboard buffer 38-16, while any switch which is open will apply a binary "1" to the inputs of keyboard buffer 38-10. Microprocessor 38-1 then causes decoder 38-9 to generate the chip enable signal E4 which causes the binary number appearing at the input of keyboard buffer to be applied to lines D0–D7 of data bus 38-3 in inverted form. Micorprocessor 38-1 reads this number into its internal register A by setting the data enable signal DEN and resetting the data transmit/receive signal DT/R. The binary number in register A will be an 8 bit binary number each bit of which corresponds to the condition of a respective switch in the scanned matrix row. A binary "1" will indicate a closed switch while binary "0" will indicate an open switch.

Once microprocessor 38-1 has read the binary number representative of the conditions of switches SW64–SW71 of row 8 of matrix 38-12 into its internal register A (and processes this information in the manner described below), it then causes the $\overline{09}$ output of strobe decoder 38-14 to be enabled and reads the binary signal representative of the condition of switches SW72–SW79 of row 9 into its internal memory. At that time, microprocessor has completed its scan of the command matrix 38-20 and then scans the character matrix 38-22. To this end, microprocessor 38-1 enables the output $\overline{00}$ of strobe decoder 38-14 and reads the binary number representative of the condition of switches SW0–SW7 of row 0 of matrix 38-22 into its internal memories. This process is repeated for rows 1–7 of matrix 38-22 with the result that the binary numbers indicative of each switch in the character matrix 38-22 is read into microprocessor 38-1. At this time, an entire scan of keyboard switch assembly 38-22 is completed.

In carrying out its program, microprocessor 38-1 often needs to store information for later use which cannot economically be maintained within its internal registers. Exemplary of this information are the variables listed in table 1, infra, and the overlay key table which is described below. To this end, keyboard 38 preferably includes a scratch pad RAM 38-7 which may be a 2186 RAM sold by Intel Corporation. Whenever a microprocessor 38-1 wishes to write information into RAM 38-7, it generates the write signal $\overline{WR}$, places appropriate information on address lines A0–A7 of address bus 38-2, appropriate data information on data lines D0–D7 of address bus 38-2 and causes decoder 38-9 to generate the chip enable signal $\overline{E1}$. To read information out of the RAM 428, the microprocessor follows the same procedure but generates the read signal $\overline{RD}$.

As noted above, the font display and text editing system 10 of the present invention writes complex characters into display RAM 26 by first generating a base character (e.g., an "a") and placing it into a character cell 46' of display RAM 26 and then generating an overlay character (e.g., an umlaut) and placing it into the same chracter cell 46' over the base character. This is performed by first generating a keyboard instruction which is a base character code and then by generating the keyboard instruction which is an overlay character code.

In the preferred embodiment, each font containing Roman characters includes nine characters corresponding to the nine diacritics set forth in the following table:

TABLE 2

| Diacritic | Example | Name |
|---|---|---|
| ' | (e) | acute accent |
| | (e) | grave accent |
| | (o) | circumflex |
| ~ | (n) | tilde |
| | (o) | macron |
| | (u) | breve |
| | (c) | hacek |
| | (a) | umlaut |
| | (c) | cedilla |

Since over 250 languages can be written using the standard Roman letters plus various combinations of the foregoing diacritics, the user can employ each of the Roman based fonts to type in a large number of different languages. Thus, it is not necessary to store a separate font for each language, although this is sometimes desirable.

It is also desirable to store diacritics or other overlay characters in connection with non-Roman character fonts. For example, in the Hebrew font, it is desirable to store characters corresponding to the Hebrew vowels: "ᵀ" "-" ".". Although the Hebrew language is normally written without the vowels, the vowels are added when text is being written for young children or other individuals not proficient in the language. Accordingly, it is desirable to be able to normally type the characters without the vowels but to add the vowels to the characters when desired.

In the English language, diacritics are not normally used and will not normally be accessed by the user. If the user is entering text information for an English language magazine, he may come to a passage which requires the entry of German text. He will then want to utilize certain diacritics and place them over appropriate base characters. For example, the German language includes both the base character "a" and the complex character "ä". Whenever the user wishes to type the German letter "a", he merely depresses the character key corresponding to the letter "a". When he wishes to generate the complex letter "ä", he first depresses the key associated with the letter "a" and then depresses the key associated with the diacritic "¨". If the key associated with a diacritic umlaut has been identified as an overlay key (the procedure for doing this is described below), the umlaut "¨" will automatically be placed over the base character "a" by the main system microprocessor 12.

In the preferred embodiment disclosed, a unique set of diacritics is provided for each font style. This is preferred to ensure that the particular shape of the diacritic corresponds in an eye pleasing manner to the particular shape of the letters of the particular font. If such a correspondence is not absolutely required, memory space can be saved by storing a single set of diacritics which can be used for each of the fonts stored in the font ROM 22. In this case, keyboard 38 will have to generate a keyboard instruction which always addresses the appropriate storage location in ROM 22 associated with a desired irrespective of the particular font being used.

In accordance with the preferred embodiment, each character associated with each of the character keys may be used as either a base character or an overlay character. As a result, the keys associated with the nine diacritics can be used to type of the diacritical characters either as a base character or as an overlay character. For example, it is sometimes desirable to use the hacek character as a base character in the text to indicate that material is to be added at the space identified by the hacek. Additionally, normal alphabetical characters can be used as overlay characters if so desired (this enables the user to create fictitious characters for special uses).

When the keyboard 38 is turned on, the system is initialized to identify all of the characters associated with the keys of the keyboard as base characters. The user may then identify one or more of the characters as overlay characters in a procedure described below. In most applications, the user will identify the key numbers associated with the nine keys containing the diacritics as overlay characters. The user may wish to identify one or more of the remaining characters of the keyboard as overlay characters. For example, if the user is to be typing substantial mathematical text, he may wish to identify the numeric character "zero" as the character $\phi$. This notation is often used in mathematical text to distinguish the numeric character "zero" from the alphabetical character "O".

In order to determine whether a KEY number generated by microprocessor 38-1 in response to the depression of particular character key is to be a base character or an overlay character, microprocessor 38-1 stores an overlay table in scratch pad RAM 38-7 which contains 128 storage locations corresponding to the 128 KEY numbers which can be generated in response to the depression of the character keys. Each address location will contain the bit "0" or the bit "1" which will indicate whether or not the KEY number is associated with a base character or an overlay character. For example, the bit "0" will be used to identify the fact that the KEY number is associated with a base character while the bit "1" will be used to indicate that the KEY number is associated with an overlay character.

When keyboard 38 is initially turned on, microprocessor 38-1 will initialize the overlay table in scratch pad RAM 38-7 by setting all of its storage locations at zero so as to indicate that all of the characters associated with the keys of the character keyboard are base characters. Thereafter, the user can change any of the characters associated with the keys of the character keyboard as an overlay character. Any character which has been transformed into an overlay character can also be redefined as a base character by the user.

The foregoing redefinition of the various characters of the character keyboard is accomplished through the use of the OVERLAY ON and OVERLAY OFF command keys of the command keyboard. Whenever the OVERLAY ON command key is depressed by the user of the system 10, microprocessor 38-1 will wait for the user to depress a character key corresponding to the character which is to be converted into an overlay character. For example, the character "umlaut" may be made into an overlay character by first depressing the OVERLAY ON command key and then depressing the key associated with the umlaut. The microprocessor 38-1 will then change the bit in the overlay table in RAM 38-7 at the address corresponding to the KEY number of the character umlaut from the binary "0" level to the binary "1" level so as to designate the umlaut as an overlay character. Thereafter, whenever the user again depresses the key associated with the umlaut, the microprocessor 38-1 will examine the overlay table in RAM 38-7, will determine that the umlaut is an overlay character, and will generate a keyboard instruction whose format block identifies its data block as an overlay character code and whose data block contains the character code for the umlaut.

Using a similar procedure, the user can establish the character "/" as an overlay character when he is entering substantial mathematical text (to enable the user to identify the number zero as $\phi$). If the user is no longer entering substantial mathematical text, he may wish to depict the numeric character "zero" in the standard manner and also will probably want to use the character "/" as a base character. In this case, the user changes the "/" back to a base character by depressing the OVERLAY OFF key and then depressing the key associated with the character "/". Thereafter, whenever the user depresses the key associated with the character "/", keyboard 38 will generate KEY instruction which identifies the character "/" as a base character.

In the foregoing description, it is assumed that there is a constant relationship between each of the switches SW0–SW63 and the 128 characters defining each font in font ROM 22. Thus, the physical key associated with the letter "a" is presumed to be physically connected to the switch SW0 and microprocessor 38-1 generates the KEY variable 0 in response to the depression of the key associated with the character "a". While such a correspondence simplifies the programming of keyboard microprocessor 38-1, such a one-to-one correspondence is sometimes undesirable. For example, it is often desirable for the keyboard to be wholly programmable so that any physical key can cause the generation of any base character and/or any overlay character. Thus, if the user were typing Spanish text, it is often necessary to type the complex character "ñ". In the above described system, this can be done by first hitting the character associated with the letter "n" followed by the character key associated with the diacritic tilde " ~ ". It would obviously be more efficient to merely dedicate a single character key to the complex character "ñ". For example, it might be desirable to dedicate the physical key which is normally associated with the tilde to cause the generation of the complex character "ñ". If this association is established, microprocessor 412 will respond to the depression of the key corresponding to the tilde by first generating a keyboard instruction identifying the base character "n" followed by a keyboard instruction identifying the overlay character "tilde". This causes the character key "tilde" to be associated with a string of characters, namely, the base character "n" followed by the overlay character "tilde". Techniques for associating a single key stroke with a succession of characters are fairly standard in the art and will not be described herein in detail. A short description of how the keyboard can be made totally programmable (so as to associate any key with any desired character or string of characters) will now be presented.

Initially, microprocessor 38-1 will establish a key number table which has 128 storage locations. The first 64 storage locations will correspond to the normally open switches SW0–SW63, respectively, when the shift key is not depressed. The last 64 storge locations will correspond to the switches SW0–SW63, respectively, when the shift key is depressed. Each storage location will store an 8 bit word, the least significant seven bits of which identify the KEY number which is associated with the associated switch SW0–SW63 as a function of the position of the shift key. The most significant bit of the 8 bit word will indicate whether the associated key is an single or string character key. The key number table can be initialized by transferring information from an appropriate ROM (or alternatively from the system microprocessor 12) into the scratch pad RAM 428 when the keyboard 38 is first turned on. In most instances, it will be desirable to have this initialized table program the keyboard to operate as a standard, or modified, QWERTY keyboard. If the user wishes to modify any of the standard QWERTY keys to identify either a different character, or a string of characters, he enters appropriate command information into the keyboard. For example, if the user wished to reprogram the key associated with the character "?" to be associated with the letter "P", he could depress the key initially associated with the letter "P", store its KEY number in an internal memory of the microprocessor 38-1, and then read this KEY number into the storage location in the keyboard table corresponding to the key which initially was associated with the character "?". Thereafter, whenever the user depresses the key "?", the microprocessor 412 will generate the KEY number for the key "P".

If the single key is to be associated with a string of characters, the most significant bit of the 8 bit word in the storage location of the keyboard table corresponding to the key depressed will identify the key as a string character key. The remaining 7 bits of this word will identify the starting address of a separate table which contains the string of characters associated with each string character key in the keyboard.

This can best be understood by way of example. If the key normally associated with the "tilde" is programmed to generate the string of characters: base character "n", overlay character "tilde", the most significant bit of the word stored in the keyboard table at the address location corresponding to the "tilde" will be a 1 (indicating that the character is a string character) and the remaining 7 bits will identify the first address location in the character string table corresponding to that character string. Let us presume that this is address location 129 in the string character table. All 11 bit word corresponding to keyboard instruction for the base character "n" will be stored at the address location 129 of the string character table. The next address location (location 130) in the string character table will contain an 11 bit word corresponding to the keyboard instruction for the overlay character "tilde". If desired, more than two characters can be associated with a single character key so that a single key strobe can cause the generation of a complex character having many diacritics such as are common in the Vietnamese language.

Once microprocessor 38-1 decides what keyboard instruction or instructions are to be sent to main system microprocessor 12, it builds the instruction in a programmable peripheral interface 462 and then sends it to the microprocessor 12. While any interface 38-8 may be used, one suitable interface is sold by Intel Corporation under the product designation 8255A interface. This interface includes four sets of peripheral side input/output ports identified as PORT A, PORT C UPPER, PORT C LOWER and PORT B, respectively. While the 8255A interface can be programmed to operate in many different modes (see pages 9–333 through 9–353 of the Component Data Catalogue dated January 1982 and published by Intel Corporation), it is used herein in the following manner.

PORT A includes output lines PA0–PA7 which will be used as an output port and will be connected to data lines D0–D7 of the data bus 14 of the main system 10 via keyboard latch 30. The PORT C UPPER port includes output lines PC4–PC7. In the present embodiment, lines PC5–PC7 of PORT C UPPER are connected to lines D8–D10 of data bus 16 via keyboard latch 30. Line PC4 is not used and is not connected to latch 30. The 11 lines PA0–PA7 and PC4–PC6 together transmit the 11 bits of each keyboard instruction.

PORT C LOWER and PORT B are used for handshaking purposes. Particularly, line PC0 of PORT C LOWER is connected to data line D11 of data bus 16 via keyboard latch 30 (the remaining lines of PORT C LOWER are not used) and line PB0 of PORT B is connected to data line D12 of data bus 16 via keyboard latch 31 (the remaining lines of PORT B are not used). As will be explained below, microprocessor 412 writes the number 0001 into PORT C LOWER (thereby placing a binary 1 on line PC0) whenever it has placed the 11 bit keyboard instruction into PORT A and PORT C UPPER so as to inform the main system microprocessor 12 that PORT A and PORT C UPPER contain the next keyboard instruction to be transmitted. Once the main system microprocessor 12 has read the keyboard instruction, microprocessor 412 causes the binary signal 0000 to be read into PORT C LOWER indicating that the keyboard 38 does not yet have a new keyboard instruction for the main system microprocessor 12 (i.e., the data appearing on output PORTs A and C UPPER represent the last keyboard instruction and not a new keyboard instruction).

As is apparent from the foregoing, PORT C LOWER of programmable interface 38-8 is used for the handshaking routine carried by microprocessors 12 and 38-1. As described above with respect to the main system 10, the main microprocessor 12 controls the handshaking routine. Microprocessor 12 initiates the handshaking routine by generating a binary "1" on data line D12 which will be applied to PORT B of programmable interface 38-8 via keyboard latch 31 when the main system microprocessor 12 is ready to receive a new keyboard instruction. As soon as microprocessor 38-1 is ready to send a new keyboard instruction, it monitors PORT B of programmable interface 38-8 to determine if the least significant bit of PORT B (corresponding to line PB0) is at the binary "1" level. If it is, this indicates that the main system microprocessor 12 is ready to receive a new keyboard instruction and microprocess 38-1 places the keyboard instruction in PORTs A and C UPPER and then places the binary number 0001 into PORT C LOWER to inform the main system microprocessor 12 that a new keyboard instruction is available for it.

In order to write appropriate information into PORT A, microprocessor 38-1 places an appropriate 8 bit number on data bus 38-3, places the address 00 on lines A0–A1 of address bus 38-2, causes decoder 38-9 to generate the chip enable $\overline{E5}$ and generates the write signal $\overline{WR}$. When microprocessor 38-1 wishes to read the appropriate information into PORT C UPPER and LOWER, it generates the appropriate 3 bit data signal on data bus 38-3, causes decoder 38-9 to generate the chip enable signal $\overline{E5}$ and generates the write signal $\overline{WR}$. When microprocessor 38-1 wishes to read information from PORT B, it generates the address 01 on lines A0–A1 of address bus 38-2, causes decoder 38-9 to generate the chip enable signal $\overline{E5}$ and generates the read signal $\overline{RD}$.

The operation of keyboard 38 will now be described with reference to the flow diagrams of FIGS. 15A–15B. The following table contains a glossary of terms which are used in the flow diagram:

TABLE 3

Glossary:

"COMMAND KEY": A variable ("0" and "1") which indicates whether the keyboard microprocessor 38-1 is scanning the command matrix 38-20 or the character key 38-20 of the keyboard switch assembly 38-10.

"FONT CODE": A number equal to N×128, wherein N equals zero for the first font stored in the font ROM 22 (ROMAN 1 in the embodiment disclosed), N equals two for the second font stored in the font ROM 22 (ROMAN 2 in the embodiment disclosd) and N equals three for the third font stored in the font ROM 22 (HEBREW in the embodiment disclosed).

"KEY": The KEY number (a number between 0 and 163) identifying the control key or the character key depressed by the user as a function of the position of the shift key.

"KEYBOARD INSTRUCTION": An 11 bit number sent by the keyboard to the system microprocessor 12 and identifying the base character, overlay character or command instruction being sent to microprocessor 12.

"KEYBOARD COLUMN": A variable number (between 0 and 7) identifying the column position of the keyboard row of the keyboard matrix 38-12 being examined.

"KEYBOARD ROW": A variable number (between 0 and 9) identifying the row on the keyboard matrix 38-12 being examined.

"LAST KEY": The KEY number of the key depressed during the last scan cycle of the keyboard matrix 38-12.

"OVERLAY OFF": A variable (0 or 1) indicating whether the next character key depressed will be made into a base character key.

"OVERLAY ON": A variable (0 or 1) indicating whether the next character key depressed will be made into an overlay key.

"OVLY (KEY)": A notation identifying the address location in the overlay table corresponding to the KEY number.

"SHIFT": A variable (0 or 64) which indicates whether or not the shift key has been depressed.

Referring now to FIG. 15A, keyboard 38 is initialized in response to a turning on of the keyboard by setting the FONT CODE, OVERLAY ON and OVERLAY OFF variables at 0. See instruction block 900. As a result, keyboard 38 will generate keyboard codes corresponding to the first font stored in font ROM 24 (i.e., ROMAN 1) until the user selects a different font by depressing one of the font command keys. As set forth in instruction block 902, all of the address locations of the overlay table stored in address RAM 38-7 are set at zero. This ensures that none of the keys of the keyboard are initially overlay keys.

Having initialized the system, microprocessor 38-1 now initiates a matrix scanning operation to determine if any character or command keys have been depressed. As noted above, microprocessor 38-1 first scans the command key matrix 38-20. To this end, microprocessor 38-1 initializes the COMMAND KEY, KEY ROW, LAST KEY and SHIFT variables as shown in instruction block 904. Particularly, the COMMAND KEY variable is set at one to indicate that the command key matrix 38-20 is being scanned; the KEY ROW variable is set at eight to indicate that row 8 of key matrix 38-12 (the first row of command matrix 38-20) is to be scanned; and sets the SHIFT variable at zero (indicating that the shift key is presumed not to be depressed until a keyboard scan indicates that it has been depressed).

The manner in which microprocessor 38-1 scans keyboard matrix 38-12 to determine if any command or character keys have been depressed will now be described with the presumption that no keys have been depressed during a single scan of the entire keyboard matrix 38-12. Microprocessor 38-1 first proceeds to instruction block 906 and applies the KEY ROW variable to strobe decoder 38-14. Since the KEY ROW variable is set at eight, strobe decoder 38-14 will enable its output $\overline{08}$ and will disable its remaining outputs. As a result, a binary number will appear at the data inputs DI0–DI7 of keyboard buffer 38-16 which is indicative of the condition (open or closed) of switches SW64–SW71 of row 8 of matrix 38-12. Particularly, any switch SW64 which is open (its corresponding key has not been depressed) will cause the application of a binary "1" to be applied to its corresponding respective input DI0–DI7, while any switch SW64–SW71 which has been closed (indicating that its corresponding command key has been depressed) will apply a binary "0" to its respective input DI0–DI7. Microprocessor 38-1 then reads the binary number (in inverted form) applied to keyboard buffer 38-16 into its internal register A by causing decoder 38-9 to generate the enable signal $\overline{E4}$ and by causing transceiver 38-5 to apply the information on data bus 38-3 to its input ports A0–A7. See block 908. As such, any bit in the binary number in register A which is at the binary "1" level indicates that the switch with which it corresponds has been closed.

Once the binary number identifying the condition of the switches of row 8 has been read into register A, microprocessor 38-1 determines if all the bits of register A are equal to zero. See block 910. Since we are presuming that none of the switches in the command matrix 38-20 have been closed, the answer will be yes and microprocessor 38-1 will proceed to instruction block 912 which causes the KEY ROW variable to increase by one. Since the KEY ROW variable was previously set at eight, it will now be equal to nine.

Microprocessor 38-1 then proceeds to decision block 914 where it determines if the COMMAND KEY variable is equal to one. Since this variable was set to one in instruction block 904, the answer will be yes. Microprocessor 38-1 then proceeds to decision block 916 where it determines if the KEY ROW variable is greater than nine. Since it is not, microprocessor 38-1 returns to instruction block 906 causing strobe decoder 38-14 to enable row 9 of keyboard matrix 38-12. Microprocessor 38-1 then reads the binary number identifying the condition of the switches of row 9 into its internal register A. See block 908. Since each of the bits of the new information read into register A will still be equal to zero, microprocessor 412 will increase the KEY ROW variable to ten. See block 912. Since the COMMAND KEY variable is still set at one (block 904), microprocessor 38-1 proceeds to block 916 and determines that the KEY ROM variable is greater than nine. Since it is, microprocessor 38-1 then proceeds to instruction block 918 where it sets the COMMAND KEY and KEY ROW variables to zero. This informs microprocessor 38-1 that it will now be scanning the command matrix 38-20 and that it will initially scan row 0 of the matrix.

Proceeding to instruction blocks 906 and 908, microprocessor 38-1 reads the binary number identifying the condition of the switches of row 0 into the internal register A of microprocessor 38-1. Since each of the bits of internal register A will still be zero (block 910), microprocessor 38-1 increases the KEY ROW variable by two (block 912). Since the COMMAND KEY variable is now zero, microprocessor 38-1 proceeds to decision block 920 where it determines if the KEY ROW variable is equal to eight. If it is not, it returns to instruction blocks 906 and 908 and reads the biinary number dentifying the condition of the switches of row 2 into internal register A. This procedure is repeated for each of the rows 0-7 of character matrix 38-22. Once row 7 of matrix 38-22 has been read into the internal register A of microprocessor 38-21, the KEY ROW variable will be equal to eight (see decision block 920), and an entire scan of the keyboard matrix 38-22 will have been completed. At this point, microprocessor 38-1 proceeds to instruction block 922 which causes it to set the "LAST KEY" variable to zero, indicating that no keys were depressed during the last scan of keyboard matrix 38-12. Microprocessor 38-1 then reinitiates a scanning cycle by returning to instruction block 904 of the software program.

The manner in which microprocessor 38-1 scans keyboard matrix 38-12 to determine if any command or character keys have been depressed will now be described with the presumption that at least one of the keys of the command key matrix 38-20 has been depressed. Starting at instruction block 904, the COMMAND KEY, KEY ROW and SHIFT variables will be set in the manner shown in block 904. The address 8 will be applied to strobe decoder 454 so as to cause the $\overline{O8}$ output of strobe decoder 38-14 to be enabled. See block 906. The binary number appearing at the data inputs DI0–DI7 of keyboard buffer 38-16 and identifying the condition of each of the individual switches SW64–SW71 of row 8 of matrix 38-12 will then be read into register A of microprocessor 38-1. See block 908. Microprocessor 38-1 determines that register A does not equal zero (see block 910) and proceeds too instruction block 924 wherein it sets the KEY COLUMN variable equal to zero. This indicates that microprocessor 38-1 will examine the bit of the binary number in register A corresponding to column 0 of row 8 (i.e., the bit identifying the condition of switch SW64).

Microprocessor 38-1 then proceeds to decision block 926 and determines if the least significant bit in register A is equal to one. If it is, switch SW64 has been depressed. As noted above, switch SW64 is the SHIFT key switch and affects the key number which microprocessor 38-1 generates in response to depression of any of the character keys. Assuming that the least significant bit in register A is equal to one, microprocessor 38-1 proceeds to decision block 928 which asks if the COMMAND KEY is one. Since microprocessor 38-1 is scanning the command key matrix 38-20, the COMMAND KEY variable will be one (it was set in block 904) and microprocessor 38-1 will proceed to instruction block 930. Instruction block 930 causes microprocessor 38-1 to set the KEY variable in accordance with the following equation:

$$KEY = 128 + KEY\ COLUMN + 8(KEY\ ROW - 8) \qquad \text{Eq. 9}$$

As such, the KEY variable will be set at 128.

Microprocessor 38-1 proceeds to decision block 932 and determines that the KEY variable is equal to 128 indicating that the SHIFT key has been depressed. For this reason, the microprocessor sets the SHIFT variable at 128 as required by instruction block 934. Having determined that the shift key has been depressed, microprocessor 38-1 now scans the character key matrix 38-22 to determine which character key has been depressed. To this end, microprocessor 38-1 sets the KEY ROW and COMMAND KEY variables at zero (see block 936) and returns to instruction block 906. This causes microprocessor 38-1 to begin scanning each of the rows of character matrix 38-22 in the manner described above. Presuming that the key corresponding to switch SW18 has been depressed (this switch corresponds to the character "S"), microprocessor 38-1 will read the binary number corresponding to the condition of switches SW0–SW7 or row 0 of character key matrix 38-22 into its internal register A and will determine that the register is zero. See blocks 906–910. As a result, it increases the KEY ROW variable by one (block 914) and returns to instruction block 906 via decision blocks 914 and 916. Microprocessor 38-1 will then read the binary number containing information concerning the condition of switches SW8–SW15 of row 1 of character matrix 38-22 into its internal register A and will again determine that the register is equal to zero. See blocks 906–910. Microprocessor 38-1 again increases the KEY ROW variable by one (it will now be equal to three) and returns to instruction block 906 via decision blocks 914 and 916. Microprocessor 412 now reads the binary number indicating the condition of switches SW16–SW23 of row 2 of character matrix 38-22 into its internal register A and will determine that the register is not equal to zero (since switch SW18 is closed). Microprocessor 38-1 then proceeds to instruction block 924 and sets the KEY COLUMN variable to zero. Proceeding to decision block 926, microprocessor 38-1 determines that the least significant bit in register A does not equal one (switch SW16 is open) and thereby increases the KEY COLUMN variable by one. See block 938. The KEY COLUMN variable will now be equal to one indicating that microprocessor 38-1 will next examine the binary bit in register A corresponding to column 2 of row 2 of character matrix 38-22. Proceeding to instruction block 940, microprocessor 38-1 shifts each of the bits in register A to the right by one with the result that the bit corresponding to column 1 of row 2 of matrix 38-22 will be placed in the least significant bit location in register A. Microprocessor 38-1 then returns to instruction block 926 and determines if the least significant bit in register A is not equal to one since switch SWD 17 is open. Microprocessor 38-1 then increases the KEY COLUMN variable to two and shifts the bits in register A to the right by one. See blocks 938 and 940. This causes the least significant bit in register A to correspond to column 2, row 2, or matrix 38-22 and thereby to correspond to the condition of switch SW18. Proceeding to decision block 926, microprocessor 38-1 determines that the least significant bit in register A is equal to one (indicating that switch SW18 is closed). Proceeding to instruction block 928, microprocessor 38-1 then determines that the COMMAND KEY variable is not equal to one (since the microprocessor 38-1 is scanning the character matrix 38-22) and proceeds to instruction block 942. In accordance with this instruction block, microprocessor 38-1 calculates the KEY variable in accordance with the following equation:

$$KEY = KEY\ ROW \times 8 + KEY\ COLUMN + SHIFT \qquad \text{Eq. 10}$$

Since the KEY ROW and KEY COLUMN variables are both set at two and since the SHIFT variable is set at 128, the KEY variable generated by microprocessor 38-1 will equal 146 which corresponds to the upper case "S" of the font in ROMAN 1 stored in font RAM 22.

Microprocessor 38-1 then proceeds to decision block 944 where it determines if the LAST KEY variable is equal to the KEY variable. If it is, this indicates that the same key had been depressed during two successive scan cycles. Since the electronic scanning speed of keyboard 38 is generally much faster than the speed at which the typist depresses and releases keys, the fact that the KEY variable generated during the last scan cycle and the KEY variable generated in the present cycle are equal indicates that a single depression of the key has taken place. Accordingly, the program effectively ignores the KEY variable generated, returns to instruction block 904 and initiates a scanning operation. If the variable LAST KEY does not equal the variable KEY, this indicates that a new key has been depressed and permits keyboard 38 to respond to the KEY variable in the required manner. Particularly, microprocessor 38-1 proceeds to instruction block 946 where it sets the LAST KEY variable equal to the KEY variable and then proceeds to decision block 948 (see FIG. 9B) which begins the command cycle portion of the program.

Returning to decision block 948, microprocessor 38-1 determines if the KEY variable is greater than 128. If it is, this indicates that a command key has been depressed. If it is not, this indicates that a character key has been depressed. It should be remembered that the KEY variable cannot be 128 because that corresponds to the shift key which does not proceed to block 948 (see block 934). If a character key has been depressed, microprocessor 38-1 must determine if it is being depressed for the purposes of setting or resetting the OVLY (KEY) variable in the overlay table or for the purpoe of causing keyboard 38 to generate a new keyboard code.

Presuming that the KEY variable is less than 128, microprocessor 38-1 proceeds to decision block 950 and determines if the OVERLAY ON variable is one. If it is, this indicates that the character key which has been depressed is to be made into an overlay key. To this end, microprocessor 38-1 sets a binary "1" in the overlay table stored in scratch pad RAM 38-7 at the address of the table corresponding to the variable KEY. See instruction block 958. Before microprocessor 38-1 causes keyboard 38 to generate any keyboard instruction in response to the depression of a character key corresponding to the variable KEY, it will examine the overlay table in scratch pad RAM 38-7 to determine if the bit at the address location corresponding to KEY variable is one. If it is, it knows that the keyboard instruction to be generated must be an overlay character code and generates the keyboard instruction accordingly. Having set the appropriate bit in the overlay key table, microprocessor 38-1 sets the OVERLAY ON variable at zero (see instruction block 954) and initiates a new scanning cycle by returning to instruction block 904.

Returning to block 950, if the OVERLAY ON variable is not equal to one, microprocessor 412 proceeds to decision block 956 and determines if the OVERLAY OFF variable is equal to one. If it is, this indicates that the character key which has just been depressed by the user must be made into a base character key. To this end, microprocessor 38-1 sets the bit in the overlay table at the address location corresponding to the KEY variable at zero (block 958). As a result, whenever the user again depresses the physical key corresponding to the KEY variable, microprocessor 38-1 will examine the appropriate bit in the overlay key table and will determine that the key is a base character key. As a result, microprocessor 38-1 will generate the keyboard instruction as a base character code. Having reset the appropriate bit in the overlay key table, microprocessor 38-1 resets the OVERLAY OFF variable to zero and initiates a new a new scanning cycle by returning to instruction block 904.

Returning again to decision block 956, if the OVERLAY OFF variable is not equal to one, this indicates that the character key last depressed by the user is to cause the generation of a keyboard instruction in response to the depression of that key. Proceeding to decision block 962, microprocessor 38-1 determines if the bit in the overlay key table in at the address location equal to the KEY variable is equal to one. If it is, this indicates that the character corresponding to the depressed character key is to be forwarded to the main system microprocessor 12 as an overlay character. To this end, microprocessor 38-1 sets the KEYBOARD INSTRUCTION variable in scratch pad RAM 38-7 in accordance with the following equation (block 964):

$$\textit{KEYBOARD INSTRUCTION} = \textit{KEY} + \textit{FONT CODE} + 1024 \qquad \text{Eq. 11}$$

The number 1024 effectively sets the two bits of the format block at binary 01 so as to indicate that the keyboard instruction is an overlay character code. The KEY and FONT CODE variables will together define the character code identifying the desired character to be removed from font ROM 22 and displayed on CRT 40. At this point, microprocessor 38-1 proceeds to the transmission sequence portion of the software program illustrated in FIG. 9C. This portion of the program will be described below.

Returning to decision block 962, if the bit stored in the overlay key table at the address equal to the KEY variable does not equal one (indicating that the last character key depressed is to be transmitted as a base character key), microprocessor 38-1 proceeds to instruction block 966 and sets the KEYBOARD INSTRUCTION variable in accordance with the following equation:

$$\textit{KEYBOARD INSTRUCTION} = \textit{KEY} + \textit{FONT CODE} \qquad \text{Eq. 12}$$

In accordance with this equation, the two most significant bits of the keyboard instruction corresponding to the format block will be set at binary 00, indicating that the keyboard instruction is a base character code and the remaining nine bits of the keyboard instruction will identify the specific character in font ROM 22 which is to be displayed on CRT 40. At this point, microprocessor 38-1 proceeds to the transmission sequence portion of the program illustrated in FIG. 9C.

Returning to decision block 948, if the KEY variable is greater than 128, a COMMAND KEY has been depressed and microprocessor 38-1 proceeds to decision block 968. If the KEY variable is equal to 129, microprocessor 38-1 sets the FONT CODE variable equal to zero (block 969) and returns to instruction block 904. If the KEY variable was not 129, microprocessor 38-1 then determines if it is equal to 130. See block 970. This indicates that the font ROMAN 2 has been selected. As a result, microprocessor 38-1 sets the FONT CODE variable at 128 (block 972) and initiates a new scanning operation by returning to instruction block 904.

If the KEY variable did not equal 130, microprocessor 38-1 continues to decision block 974 and determines if the KEY variable is equal to 131. If it is, this indicates that the HEBREW font has been selected. Accordingly, microprocessor 38-1 sets the FONT CODE variable at 256 and initiates a new matrix scanning operation by returning to instruction block 904. See block 976.

If the KEY variable did not equal 131, microprocessor 38-1 proceeds to decision block 978 and determines if the KEY variable is equal to 132. If it is, this indicates that the OVERLAY ON key has been depressed. As a result, microprocess 38-1 sets the OVERLAY ON variable (see block 980) and initiates a further scanning operation of the matrix 38-12 by returning by to instruction block 904.

If the KEY variable did not equal 132, microprocessor 38-1 continues to decision block 982 and determines if the KEY variable is equal to 133. If it is, this indicates that the OVERLAY OFF key has been depressed and microprocessor 38-1 sets the OVERLAY OFF variable. See instruction block 984. Microprocessor 38-1 then initiates a matrix scanning operation by returning to instruction block 904.

Finally, if the KEY variable did not equal 133, microprocessor 38-1 knows that a command key (cursor left, cursor right, carriage return or backspace) has been depressed and, therefore, sets the KEYBOARD IN- STRUCTION variable equal to KEY+3262 (block 986). The number 3262 effectively places the binary digits 11 in the format block of the keyboard instruction. See instruction block 986. Microprocessor 38-1 then proceeds to the output section of the program illustrated in FIG. 9C.

Proceeding to instruction block 988, microprocessor 38-1 reads PORT B from programmable interface 38-8 into its internal register B. Microprocessor 38-1 then determines if the least significant bit in register B is equal to one. See decision block 990. If it is not, this indicates that the main system microprocessor 12 is not yet ready to receive a new command instruction. Accordingly, the program will return to instruction block 988 and microprocessor 38-1 will continue polling PORT B of programmable interface 38-8 until the main system microprocessor sets the least significant bit of that port at "1". At that point, microprocessor 38-1 will begin building the 11 bit keyboard instruction into interface 38-8. To this end, microprocessor 38-1 first writes bits 0-7 of the KEYBOARD INSTRUCTION variable contained in RAM 38-7 into PORT A of programmable interface 38-8. See instruction block 992. Microprocessor 38-1 then writes bits 8-10 of the KEYBOARD INSTRUCTION variable contained in RAM 428 into PORT C UPPER of interface 38-8. See instruction block 944. Having written all 11 bits of the KEYBOARD INSTRUCTION into interface 38-8, microprocessor 38-1 now writes the binary number 0001 into PORT C LOWER of programmable interface 38-8 so as to inform the main system microprocessor 12 that a new keyboard instruction is available at the output ports of interface 38-8. See instruction block 996.

Proceeding to instruction block 997, microprocessor 38-1 reads PORT B from the programmable interface 38-8 into its internal register C. If the least significant bit of register C is zero, this indicates that the main system microprocessor 12 has not yet read the new keyboard instruction. Accordingly, microprocessor 412 continues to poll PORT B of interface 38-8 until the least significant bit of that port is equal to zero (indicating that the main system processor 12 has read the keyboard instruction). At that point, microprocessor 38-1 reads the binary word 000 into PORT C LOWER of interface 38-8 (see block 999) which indicates that the keyboard instruction appearing at the output of interface 38-8 is not a new instruction. Microprocessor 38-1 then initiates a new scanning operation of keyboard matrix 39-12 by returning to instruction block 906.

As used in the following claims, the term "alphabetical characters" shall be interpreted as including alphanumeric characters as well as idiographic characters.

The present invention may be embodied in other specific forms without departing from the spirit or essential attributes thereof and, accordingly, reference should be made to the appended claims, rather than to the foregoing specification as indicating the scope of the invention.

What is claimed is:

1. A font display and text editing system, comprising:

a display device which is logically broken into a plurality of character spaces;

a memory storing digital information describing the shape of each alpha-numeric character of a set of alpha-numeric characters and each diacritical character of a set of diacritical characters;

human actuable input means for generating a first signal identifying any one of said alpha-numeric and diacritical characters as a base character and a second signal identifying any one of said alpha-numeric and diacritical characters as an overlay character; and hit mapped memory means responsive to said first and second signals for combining said first and second signals in a manner which causes said base and overlay characters to be displayed as a single complex character in a single said character space of said display device.

2. The system of claim 1, wherein said input means includes a keyboard and wherein said input means sequentially generates both said first and said second signals in response to the actuation of a single key on said keyboard.

3. The system of claim 2, wherein said memory stores digital information describing the shape of each alphanumeric character of a plurality of sets of alpha-numeric characters, each set of alpha-numeric characters defining a respective font.

4. The system of claim 3, wherein said human actuable input means and said responsive means cooperate to enable diacritical characters to be combined with base characters of all of said fonts.

5. The system of claim 3, wherein characters from different said sets of characters can be displayed on said display device simultaneously.

6. The system of claim 1, wherein said input means and said responsive means cooperate to permit the user of said system to change the position of said characters on said display device.

7. The system of claim 3 wherein alphanumeric characters from different said sets of responsive means characters can be displayed on said display device simultaneously.

8. The system of claim 1, wherein said input means and said responsive means cooperate to permit the position of said characters displayed on said display device to be changed.

9. The system of claim 1, wherein each alpha-numeric and diacritical character is stored in said memory as a unique set of binary numbers which describe the shape of that character.

10. The system of claim 9, wherein the shape of each character is defined by an array of n rows and m columns of binary numbers, each column indicating whether or not a pixel is to appear at a corresponding pixel location on said display medium, n and m being positive integers.

11. The system of claim 10, wherein each of said small end rows is a binary word and said array is stored as n binary words, each word including m bits of information.

12. The system of claim 11, in which each word of a given character is stored in sequential locations in said memory.

13. The system of claim 12, wherein each character is assigned a unique character code which identifies the storage location of said memory at which said first word of that character is stored.

14. The system of claim 13, wherein said signal generated by said input means identifies the character code of the character selected by said user.

15. The system of claim 14, wherein said responsive means responds to said signal by sequentially reading each word of the character identified by said character code out of said memory and displaying the corresponding character on said display device.

16. The system of claim 1, wherein said display device is able to display one page of text at a time and wherein said system further includes a second memory for storing each of said signals generated by said input device and corresponding to said one page of text displayed on said display device.

17. The system of claim 16, wherein said responsive means erases the page of information displayed on said display device responsive to an appropriate control signal generated by said input means, and wherein said system further includes means for transferring all of said signals stored in said second memory into a mass memory when said responsive means erases said page of information displayed on said display device.

18. The system of claim 1, wherein said responsive means includes:

a bit mapped RAM which contains an array of g by p storage locations and wherein said display device is divided into g by p pixel locations, said storage locations corresponding to said pixel locations on a one-to-one basis, g and p being positive integers much greater than 1; and means for displaying, on said display device, the information stored in said bit mapped RAM.

19. The system of claim 18, wherein $800 \leqq g \leqq 1100$ and $800 \leqq p \leqq 1100$.

20. The system of claim 19, wherein said display device is a cathode ray tube divided into 800 to 1100 lines of information, each line containing 800 to 1100 pixel locations such that each pixel location corresponds to a corresponding one of said storage locations on a one-to-one basis.

21. The system of claim 20, wherein each character as stored in said memory is a unique set of binary numbers which describe the shape of that character.

22. The system of claim 21, wherein the shape of each character is defined by an array of n rows and m columns of binary numbers, each binary number indicating whether or not a pixel is to appear at one or more corresponding pixel locations on said display medium, n and m being positive integers much less than p and g, respectively.

23. The system of claim 22, wherein said array is stored as n binary words, each word including m bits of information.

24. The system of claim 23, wherein each word of a given character is stored in sequential locations in said memory.

25. The system of claim 24, wherein each character is assigned a unique character code which identifies the storage location of said memory at which said first word of that character is stored.

26. The system of claim 25, wherein said signal generated by said input means identifies the character code of the character selected by said user.

27. The system of claim 19, wherein said responsive means responds to said signal by sequentially reading each word of the character identified by said character code out of said memory and storing corresponding bits of information in corresponding storage locations of said bit mapped RAM.

28. The system of claim 18, wherein said input means includes a keyboard and wherein said input means sequentially generates both said first and said second signals in response to the actuation of a single key on said keyboard.

* * * * *

UNITED STATES PATENT AND TRADEMARK OFFICE

CERTIFICATE OF CORRECTION

PATENT NO. : 4,603,330

DATED : July 29, 1986

INVENTOR(S) : Gary D. HORNE et al.

It is certified that error appears in the above-identified patent and that said Letters Patent are hereby corrected as shown below:

Claim 1, column 44, line 5, change "hit" to --bit--.

Signed and Sealed this

Twenty-ninth Day of December, 1987

*Attest:*

DONALD J. QUIGG

*Attesting Officer*

*Commissioner of Patents and Trademarks*